US010906087B1

(12) United States Patent
Matzen et al.

(10) Patent No.: US 10,906,087 B1
(45) Date of Patent: Feb. 2, 2021

(54) DIE FOR THE MANUFACTURING OF ELONGATE BODIES

(71) Applicant: Enkotec A/S, Skanderborg (DK)

(72) Inventors: Claus Peter Matzen, Silkeborg (DK); Preben Kirk Elkjaer, Skanderborg (DK)

(73) Assignee: Enkotec A/S, Skanderborg (DK)

( * ) Notice: Subject to any disclaimer, the term of this patent is extended or adjusted under 35 U.S.C. 154(b) by 0 days.

(21) Appl. No.: 16/778,670

(22) Filed: Jan. 31, 2020

Related U.S. Application Data

(63) Continuation of application No. PCT/EP2019/073650, filed on Sep. 5, 2019.

(51) Int. Cl.

| | |
|---|---|
| ***B21J 13/02*** | (2006.01) |
| ***B21G 3/28*** | (2006.01) |
| ***B21G 3/32*** | (2006.01) |
| ***B21G 3/16*** | (2006.01) |

(52) U.S. Cl.
CPC ..... *B21J 13/025* (2013.01); *B21G 3/16* (2013.01); *B21G 3/28* (2013.01); *B21G 3/32* (2013.01)

(58) Field of Classification Search
CPC ..... B21J 13/02; B21J 13/025; B21G 3/12; B21G 3/16; B21G 3/18; B21G 3/28; B21G 3/32
See application file for complete search history.

(56) References Cited

U.S. PATENT DOCUMENTS

| | | | | |
|---|---|---|---|---|
| 3,965,716 | A | 6/1976 | Suzuki et al. | |
| 6,780,116 | B2 * | 8/2004 | Hurst | B21G 3/12 470/121 |
| 7,004,846 | B2 | 2/2006 | Hurst et al. | |
| 8,998,733 | B2 | 4/2015 | Kim | |
| 2010/0130295 | A1 | 5/2010 | Yao | |

FOREIGN PATENT DOCUMENTS

| | | |
|---|---|---|
| EE | 01325 | 11/2015 |
| EE | 201500028 | 4/2017 |
| GB | 252195 | 5/1927 |
| WO | WO0037195 | 6/2000 |
| WO | WO2009052538 | 4/2009 |

OTHER PUBLICATIONS

Charvet, Pierre, International Search Report and Written Opinion issued in Europe for PCT/EP2019/073650; dated Nov. 25, 2019; 18 pages.
Charvet, Pierre, Extended European Search Report, including the Annex to the Search Report, and the European Search Opinion: Patent Application No. EP18203697; dated Apr. 4, 2019; 7 pages.

* cited by examiner

*Primary Examiner* — Pradeep C Battula
(74) *Attorney, Agent, or Firm* — Ulmer & Berne LLP

(57) ABSTRACT

A die holder mounts a die to form heads on nails or screws. A top surface of the die includes a groove for longitudinally receiving and holding an elongate body. The die has a recess merging into the groove at one end of the groove to form a nail or screw head. The die is conical for press fit by contact with an inner surface of a bore or hole in the die holder. A top surface of the die is planar to a top surface of the die holder with a bottom surface engaging bottom part of the die holder. The bottom portion of the die has a recess or engaging with a corresponding protrusion die holder fixing an angular orientation of the groove relative to the die holder. Two opposite dies are brought together by two opposite die holders forming the head.

24 Claims, 19 Drawing Sheets

DIE FOR THE MANUFACTURING OF ELONGATE BODIES

CROSS-REFERENCE TO RELATED APPLICATIONS

This application is a Continuation of PCT/EP2019/073650 filed Sep. 5, 2019, which is incorporated herein by reference.

FIELD OF THE INVENTION

The present invention relates to a new design of tooling, specifically a die and die ring, for production of elongate bodies, such as nails or screws in a wire-fed nail machine.

BACKGROUND OF THE INVENTION

In an existing nail-machine one of the main-issues is the wear and related replacement of dies for production of said nails, especially forming the head on the nail. The machine is continuously fed with a raw material, a wire, which is shaped into nails through pressure from a stamping, rolling or roll forming process which includes two corresponding dies.

In some nail-machines, the dies are fixated, with thread based fastening means, to a rotating ring tool within the nail-machine, the dies arranged around the ring tool. Replacing the dies on a regular basis is a labour intensive task where several fastening elements are involved to fasten each die. Furthermore, tolerances of each of the fastening elements involved in fastening of the die tend to degrade position precision of the die in the die holder, and thus in the end reduce the quality of the nails as well as introducing wear. An example of such nail producing machine can be seen e.g. in EP 1 631 400 B1.

Hence, an improved die for the manufacturing of elongate bodies would be advantageous, and in particular a more efficient and/or reliable method of replacing the dies would be advantageous.

OBJECT OF THE INVENTION

In particular, it may be seen as an object of the present invention to provide a die for the manufacturing of elongate bodies that solves the above mentioned problems of the prior art with simplified replacement of dies within the die holder, such as a tool ring, reducing down-time and increasing yield from a nail-machine. At the same time, it is preferred that the die is precisely positioned in the die holder.

SUMMARY OF THE INVENTION

Thus, the above described object and several other objects are intended to be obtained in a first aspect of the invention by providing a die for mounting in an associated die holder for the production of heads on elongate bodies, such as a metal nail or screw, the die comprising:

a body with a top surface provided with a through-going groove, such as with gripping marks, for receiving and holding an elongate body longitudinally in said groove, a recess at one end of the groove suitable for forming the head on the elongate body, a side surface shaped for press fit by contact with an inner surface of a bore or hole in the associated die holder, a bottom stop surface for engaging with a stop part in the hole or bore of the associated die holder, so as to determine a height of the die in relation to the associated die holder, e.g. a height of the groove relative to a surface of the die holder, and a recess or protrusion serving to engage with a corresponding protrusion or recess of the associated die holder, in order to fix angular orientation of the groove relative to the die holder.

In the context of the present invention, 'die' is to be understood as a tool or device for imparting a desired shape, form, or finish to a material or for impressing an object or material, such as shaping the head on a nail or screw from a metal wire.

In the context of the present invention, 'recess' is to be understood as a depression into part of a surface, such as, but not limited to, a cleft, cut or cavity. In the context of the recess for forming the head on the elongate body, the recess can be a combination of a cut out for forming a surface, e.g. a plane surface, suitable for forming the head by applying pressure on the end of the elongate body when being held by the groove. Further, the recess may comprise specific features for forming a specific head shape on the elongate body, e.g. a chamfer and/or a round etc.

In the context of the present invention, 'head' is to be understood as the uppermost extremity or projecting part of an object.

In the most preferred embodiments, the groove is perpendicular or substantially perpendicular to a central longitudinal axis through the body between top surface and bottom part of the body of the die. Preferably, the groove is perpendicular to the central longitudinal axis through the body. Especially, a small offset angle of such as 0.1° may be preferred, and thus most preferably, the groove forms an angle of 89.8°-90.2° with the central longitudinal axis through the body of the die.

In an embodiment of the invention, the recess or protrusion serving to fix angular orientation is shaped so as to guide the die into the corresponding protrusion or recess of the associated die holder. This will reduce the time spend on aligning the die surface in respect to the direction from which the wire is fed into the groove.

In an embodiment of the invention, the elongate body is processed into rivets.

In an embodiment of the invention, the elongate body is processed into spokes, such as, but not limited to, spokes for a bicycle.

In an embodiment of the invention, the wire to be fed into the machine is smooth.

In an embodiment of the invention, the wire to be fed into the machine is profiled, such as a round, square or spline profile.

In an embodiment of the invention, the die has a cylindrical shape, which could improve the durability of the die, as sharp edges are usually the weakest point, most prone to chipping, when using alloy-steels suitable for tools.

In general, the die can be formed by a variety of material including metals as well as non-metals.

In the context of the present invention, 'alloy steels' is to be understood as steels that are well-suited to be made into tools. Alloying elements such as, but not limited to Tungsten, Chromium, Vanadium or Molybdenum are added, forming carbides in the steel, to increase the hardness, corrosion and heat resistance, abrasiveness and deformation of the steel.

In an embodiment of the invention, at least a part of the die could be made from cement carbide, or a ceramic, such as Oxide ceramics with e.g. Zirconia additives, Mixed ceramics with e.g. carbides or Silicon nitride ceramics and SiAlON grade ceramics. Ceramics have excellent wear resistance which could improve the durability of the die or the die holder.

In an embodiment of the invention, at least a part of the body of the die is tapered improving the fixation of the die within the die holder. In preferred embodiments, the tapered part of the body of the die, or the entire body of the die, has a circular cross section. It is to be understood that the circular cross section may likewise be slightly elliptic or lightly oval.

In an embodiment of the invention at least a part of the body of the die has a conical shape, such as wherein a side surface of said part of the body providing an angle of 0.1°-3°, such as 0.5°-2.5°, such as 1.0°-2.0°, with a central axis of the body.

In an embodiment of the invention, the die has at least one recess forming a shoulder, preferably with a chamfer, for guiding the die into an associated die holder, wherein the recess has a corresponding protrusion within said die holder, in order to fix angular orientation of the groove relative to the die holder.

In an embodiment of the invention, the die has a stop surface with at least one surface on a lower part of the body of the die for engaging with a bottom surface or lower shoulder surface in the hole or bore of the associated die holder.

In an embodiment of the invention, the top surface of the die and the surface part of the die holder are to be substantially plane in respect to each other when the stop surface of the die is abutting said bottom surface or lower shoulder surface of the die holder.

In an embodiment of the invention, the die has one or more holes or bores in the bottom surface and the die holder has one or more pins corresponding to said holes or bores, the pins engaging with the holes or bores, in order to fix angular orientation of the groove relative to the die holder.

In an embodiment of the invention, the stop surface of said die has an inclined groove so as to ease the extraction or ejection of said die when seated in an associated die holder, when applying pressure with an elongate tool, such as a pin, preferably with a inclined tip corresponding to the inclination of the groove thereby driving the die out of the associated die holder without damaging said die holder or elongate tool.

In an embodiment of the invention, the inclined groove on the stop surface of the die has an angle between 1° to 40°, such as between 2° to 30°, such as 5° to 20° or such as 8° to 15°, relative to the stop surface of the die, wherein the angle reduces the pressure needed to extract said die from an associated die holder.

In the context of the present invention, inclined groove is to be understood as a narrow cut or low area in a surface angled from one area in said surface to another area in said surface and wherein the groove varies in depth, relative to said surface from one end of the groove to the opposite end of the groove.

In an embodiment of the invention, the bottom surface of the die has an inclined groove so as to ease the extraction or ejection of said die when seated in an associated die holder, when applying pressure with an elongate tool, such as a pin, preferably with a inclined tip corresponding to the inclination of the groove thereby driving the die out of the associated die holder without damaging said die holder or tool.

In some embodiments of the die, the stop surface and the bottom surface are one and the same. In some embodiments, the stop surface may be a recess cut into the body of the die at a position above the bottom surface.

In an embodiment of the invention, the inclined groove on the bottom or stop surface of the die has a width (W) and the die has an outer diameter (D), and where a ratio (W/D) between said width and said outer diameter is between 0.01 and 1, more preferably between 0.1 and 0.5 as these ratios are ideal for the production of dies from steel, such as from tool grade steel or other hard alloys, especially such as a hard metal, e.g. tungsten carbide, or other hard materials suitable for the production of elongate bodies, such as a nail or screw.

In another embodiment of the invention, the inclined groove has at least a plane surface part so as to reduce friction between an elongate tool and the plane surface, thereby easing the ejection of the die from die holder, when said die is firmly seated in said die holder.

In an embodiment of the invention, the groove is a plane surface being parallel with an axis perpendicular to a central axis of the die, so as to ease the insertion of an elongate tool for the ejection of the die from die holder, when said die is firmly seated in said die holder.

In an embodiment of the invention, the plane surface has an inclination angle of 0.5° to 50°, such as 1° to 40° or such as 2° to 20° relative to the stop surface or bottom surface of the die.

In an embodiment of the invention, the inclined groove has at least a curved surface part.

In an embodiment of the invention, the outer diameter (D) of the die and an overall height (H) of the die has a ratio (D/H) between 0.1 and 5 or more preferably between 0.5 and 2.0 to optimize manufacturing costs of the die and an associated die holder, such as a tool ring.

In a second aspect, the present invention relates to an elongate tool comprising a tip shaped to match the groove of the die according to the first aspect of the invention, wherein the elongate tool is arranged to remove the die from an associated die holder.

In the context of the present invention, it is to be understood that the elongate tool may be used as a wedge, wherein the tip of said elongate tool is wedged between a bottom surface of the die and the bottom surface of the associated die holder, so as to apply a pressure for pushing the die upwards and out of the bore or hole in the die holder.

In an embodiment of the invention, the tip on the elongate tool has an inclined flat surface arranged for engagement with an inclined flat surface of the inclined groove of the die, so as to ease the ejection of said die seated in an associated die holder.

In a third aspect, the present invention relates to a die holder comprising:

a body having at least a top surface part, a plurality of holes or bores in the top surface part, wherein each of the plurality of holes or bores has an inner surface shaped for receiving a die and for press fit by contact with the side surface of the die, a stop part located in the hole or bore for engaging with a stop surface of the die when being pressed into the hole or bore, so as to fix a height of a top surface of the die in relation to the top surface part of the die holder, and a protrusion or recess serving to engage with a corresponding recess or protrusion of the die, in order to fix angular orientation of the die relative to the die holder.

This aspect of the invention is particularly, but not exclusively, advantageous in that the die holder according to the present invention may be implemented by insertion in an older, less advanced machine, such as a nail manufacturing machine, as an upgrade kit. The invention is advantageous for new nail or screw manufacturing machines, as well as existing machines which can be modified or updated to include a die holder with dies according to the first aspect of the invention.

In an embodiment of the invention, the top surface part of the die holder is ring-shaped, and the plurality of holes or bores are evenly distributed on the ring-shaped top surface part so as to ensure structural integrity of said die holder.

In an embodiment of the invention, the die holder comprises at least 10 holes or bores evenly distributed on the ring-shaped top surface part, such as 10-100 holes or bores, so as to maximize the amount of said bores or holes on said ring-shaped top surface. In specific embodiments, the die holder may have such as 24, 30, 36, 40, 48, or 60 holes or bores evenly distributed on the ring-shaped top surface part of the die holder, however other numbers of holes or bores may be preferred.

In an embodiment of the invention, the body of the die holder is monolithic and made of a metals so as to decrease the amount of parts needed to fixate a die in said die holder.

In a fourth aspect, the present invention relates to a machine for producing elongated bodies, such as nails, the machine comprising:

a die according to the first aspect of the invention, and a die holder comprising:

a body having at least a substantially plane top surface part, a hole or bore in the substantially plane top surface part, wherein the hole or bore has an inner surface shaped for receiving the die and for press fit by contact with the side surface of the die, a stop part located in the hole or bore for engaging with the bottom surface of the die when being pressed into the hole or bore, so as to fix a height of the top surface of the die in relation to the top surface part of the die holder, and a protrusion or recess serving to engage with a corresponding recess or protrusion of the die, in order to fix angular orientation of the groove of the die relative to the die holder.

In the context of the present invention, 'press fit' is to be understood as the fit of a body driven into a hole slightly smaller than itself to be held tight and motionless.

In an embodiment of the invention, the top surface part of the die holder is substantially ring-shaped, having a central axis of rotation, the ring-shaped die holder being mounted so as to rotate about said axis.

In an embodiment of the invention, the machine has two opposite ring-shaped die holders, the die holders angled or slanted so as to, when rotating, to bring two opposite dies close enough together to almost brush against each other.

In an embodiment of the invention, the top surface of the ring-shaped circular die holder has a plurality of holes or bores, such as 10-100 holes or bores, arranged for mounting of respective dies according to the first aspect of the invention.

In an embodiment of the invention, the plurality of holes or bores are parallel and evenly distributed around the top surface part of the ring-shaped die holder.

In an embodiment of the invention, the die holder body has an opening, such as a hole or bore, connected to a bottom part of the hole or bore shaped for receiving and holding the die, so as to allow an elongate tool to engage with a lower part of the die to push the die upwards for removal of the die from the die holder, such as by exerting a force between the bottom surface of the die and a surface of the die holder. This embodiment is particularly, but not exclusively, advantageous for fast and simple removal of a worn-down or chipped die from the die holder, which will could significantly reduce the down-time of a machine.

In an embodiment of the invention, the opening, for the insertion of the elongate tool into the die holder body, is a hole or bore perpendicular to the hole or bore for receiving and holding the die.

In an embodiment of the invention, the die holder is ring-shaped, and the opening for the insertion of the elongate tool into the die holder body, is located on an inner side of the ring, so as to allow removal of the die, when the die holder is mounted for normal operation.

In an embodiment of the invention, the die holder has one or more pins located in the hole or bore, serving to engage with a corresponding protrusion or recess of the die to fix angular orientation of the groove relative to the die holder.

The machine may especially be a nail producing machine, such as for producing nails with round heads, or for producing nails with D-shaped heads. The machine may alternatively be a screw producing machine, e.g. for producing heads on threaded elongate bodies.

In a fifth aspect, the present invention relates to a method for manufacturing a head on an elongate body, such as metal nails or screws, using the die according to the first aspect. In an embodiment, the method comprising:

a. providing first and second die holders, each of the first and second die holders comprising:
   i. a body having at least a substantially plane top surface part,
   ii. a hole or bore in the substantially plane top surface part, wherein the hole or bore has an inner surface shaped for receiving the die and for press fit by contact with a side surface of the die,
   iii. a stop part located in the hole or bore for engaging with a bottom surface of the die when being pressed into the hole or bore, so as to fix a height of the top surface of the die in relation to the top surface part of the die holder, and
   iv. a protrusion or recess serving to engage with a corresponding recess or protrusion of the die, in order to fix angular orientation of the groove of the die relative to the die holder.
b. providing first and second dies, each of the first and second dies comprising:
   i. a body with a top surface provided with a through-going groove for receiving and holding an elongate body longitudinally in said groove,
   ii. a recess at one end of the groove suitable for forming the head on the elongate body,
   iii. a side surface shaped for press fit by contact with an inner surface of a bore or hole in the associated die holder,
   iv. a bottom surface for engaging with a stop part in the hole or bore of the associated die holder, so as to determine a height of the top surface of the die in relation to a surface part of the associated die holder, and
   v. a recess or protrusion serving to engage with a corresponding protrusion or recess of the associated die holder, in order to fix angular orientation of the groove relative to the die holder,
c. bringing the top surface of the first die so near to the top surface of the second die that the grooves of the first and second dies hold the elongate body, and
d. providing force onto the elongate body at the recess end of the grooves so as to form a head on the elongate body.

This aspect of the invention is particularly, but not exclusively, advantageous in that the method according to the present invention may be implemented by providing a ring shaped die holder according to the third aspect and the die according the first aspect. The invention is advantageous for new nail or screw manufacturing machines, as well as existing machines which can be modified or updated to include a die holder with dies according to the invention.

In a sixth aspect, the present invention relates to a method for manufacturing a head on an elongate body, such as a nail, using the die holder according to the third aspect of the invention.

This aspect of the invention is particularly, but not exclusively, advantageous in that the method according to the present invention may be implemented by inserting a die holder according the second aspect, in an older, less advanced machine, such as a nail manufacturing machine, as an upgrade kit. The invention is advantageous for new nail or screw manufacturing machines, as well as existing machines, which can be modified or updated to include a die holder with dies according to the first aspect of the invention.

In a seventh aspect, the present invention relates to a method for manufacturing a head on an elongate body, such as a nail, using the machine according to the fourth aspect of the invention.

In an eighth aspect, the present invention relates to a method for ejecting a die according to the first aspect of the present invention from an associated die holder according to the third aspect of the invention, wherein said method comprises:

providing an elongate tool, such as a pin, inserting said elongate tool into an opening of the associated die holder, applying a force in a length axis of the elongate tool towards the die so as to force said die to eject from the associated die holder, in a direction substantially perpendicular to the direction of the applied force.

This aspect of the invention is particularly, but not exclusively, advantageous in that the method according to the present invention may be implemented by using an elongate tool according to the second aspect of the invention in combination with the die according to first aspect of the invention and the die holder according to the second aspect, in an older, less advanced machine, such as a nail manufacturing machine, as an upgrade kit. The invention is advantageous for new nail or screw manufacturing machines, as well as existing machines, which can be modified or updated so as to faster replace any damaged dies from the die holder and hence, reduce down time on the manufacturing machine.

In an embodiment of the invention, the method comprises engaging between a tip of the elongate tool and a groove in the stop part or a bottom part of the die, wherein said tip and said groove are shaped to match so as to facilitate ejection of the die.

In an embodiment of the invention, the groove comprises a plane surface with an inclination angle between 1° to 40° or such as between 2° to 20° relative to the stop surface or bottom surface of the die, and wherein a tip on the elongate tool has a plane surface shaped to engage with said plane surface of the groove.

In a ninth aspect, the present invention relates to the use of a die according to the first aspect of the invention for manufacturing a head on an elongate body, such as a nail.

In a tenth aspect, the present invention relates to the use of a die holder according to the third aspect of the invention, for manufacturing a head on an elongate body, such as a nail.

In an eleventh aspect, the present invention relates to the use of a machine according to the fourth aspect of the invention, for manufacturing a head on an elongate body, such as a nail.

In a twelfth aspect, the invention provides a nail manufactured according to any of the fifth, sixth or seventh aspect.

In a thirteenth aspect, the invention provides a method of manufacturing nails comprising:

receiving and holding an elongate body longitudinally in a groove on a top surface of a body, forming a head on an elongate body via a recess at one end of the groove, press fitting, by contact, a side surface with an inner surface of a bore or hole in an associated die holder, engaging a stop surface with a stop part in the hole or bore of the associated die holder, so as to determine a height of the die in relation to the associated die holder, and engaging a recess or protrusion with a corresponding protrusion or recess of the associated die holder to fix an angular orientation of the groove relative to the die holder.

The first, second, third, fourth, fifth, sixth, seventh, eighth, ninth, tenth, eleventh, twelfth and thirteenth aspect of the present invention may each be combined with any of the other aspects. These and other aspects of the invention will be apparent from and elucidated with reference to the embodiments described hereinafter.

BRIEF DESCRIPTION OF THE FIGURES

The die according to the invention will now be described in more detail with regard to the accompanying figures. The figures show one way of implementing the present invention and is not to be construed as being limiting to other possible embodiments falling within the scope of the attached claim set.

DETAILED DESCRIPTION OF EMBODIMENTS

Figure 1:
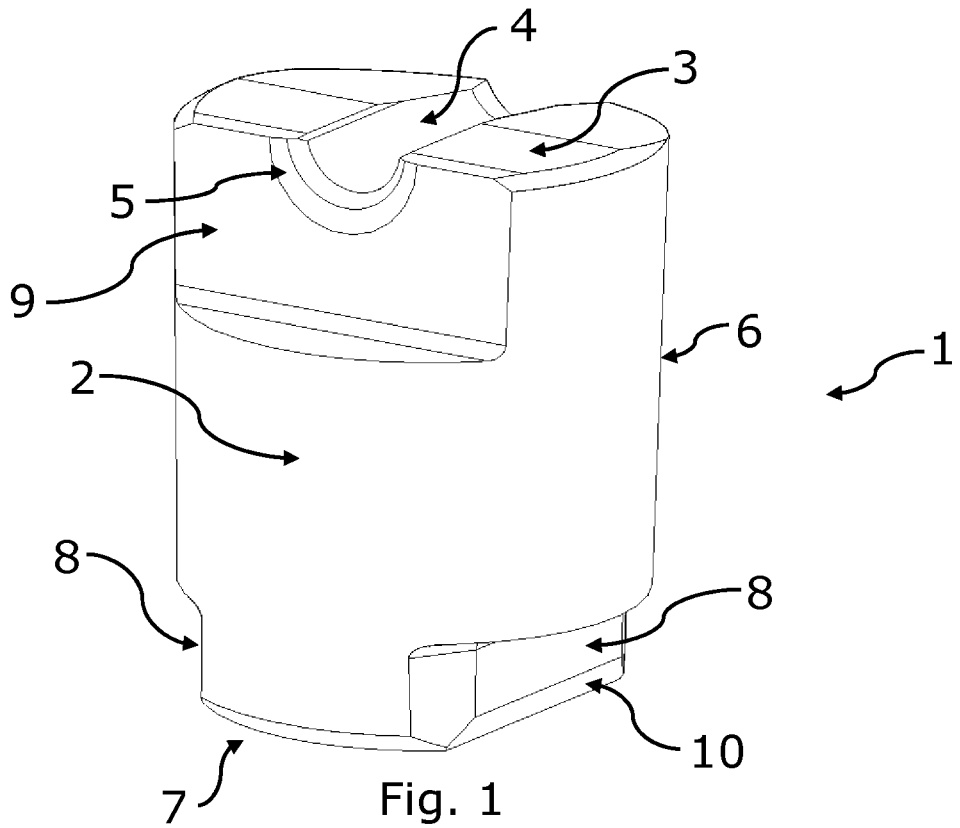
FIG. 1 is a trimetric view of a die embodiment.

FIG. 1 is a trimetric view of a die 1 embodiment. The figure illustrates a die 1 for mounting in an associated die holder for the production of heads on elongate bodies, such as a metal nail or screw. The die 1 comprises a body 2 with a top surface 3. The top surface has a through-going groove 4 suitable for receiving and holding the elongate body longitudinally in the groove 4. The groove 4 may have gripper marks (not visible) for increased friction with the elongate body to improve the holding effect. The body 2 of the die 1 has a cut-out surface 9 on one side and the cut-out surface 9 has a recess 5, which extends from the cut-out surface 9 and merges into the groove 4. The recess 5 is shaped to form half of the head on the elongate body. The die 1 has a side surface 6 shaped for press fit by contact with an inner surface of a bore or hole in the associated die holder. The die 1 has a bottom surface 7 with a chamfer 10 for easy mounting of the die 1 into the hole or bore of the associated die holder. At the lower portion of the body 2 there are two opposite recesses 8 serving to engage with a corresponding protrusion of the associated die holder, in order to fix angular orientation of the groove 4 relative to the die holder.

Figure 2:
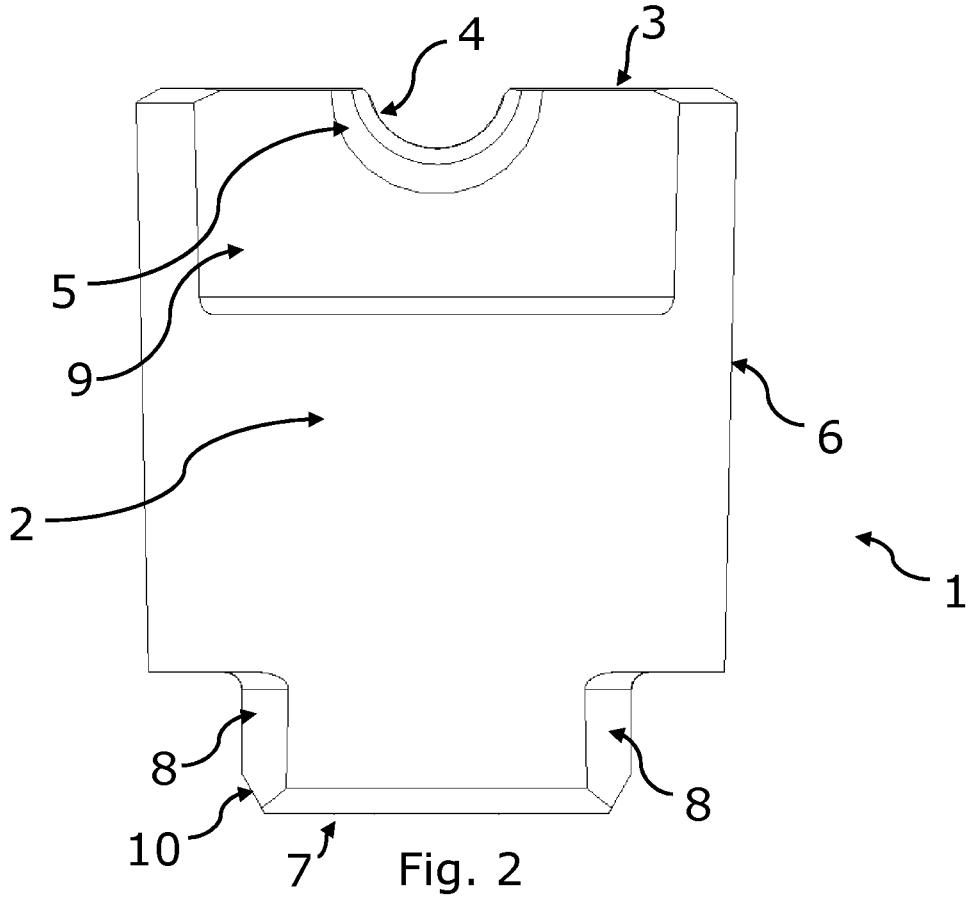
FIG. 2 is a side view of a die embodiment.

FIG. 2 is a side view of a die 1 embodiment having a conical shaped side surface 6. The figure illustrates the body 2 of the die 1 when viewed directly towards the cut-out surface 9. The cut-out surface has a recess 5, which merges into the groove 4 on the top surface 3 of the die 1. The recess 5 is substantially round, shapes so at to form half of the head of a nail or screw. The side surface 6 of the die 1 is angled, suitable for press fitting into a corresponding shape of a die holder. The angle of the side surface 6 with a central axis of the body 2 is between one and two degrees in this particular embodiment, but could be in the range of a tenth of a degree to 5 degrees. On the bottom portion of the die 1 two opposite recesses 8 are shaped to engage with corresponding protrusions or shoulders to fix the angular orientation of the recess 5 and groove 4 relative to the die holder. The bottom surface 7 of the die 1 is chamfered 10 for easy insertion and guiding of the die 1 into the die holder.

Figure 3:
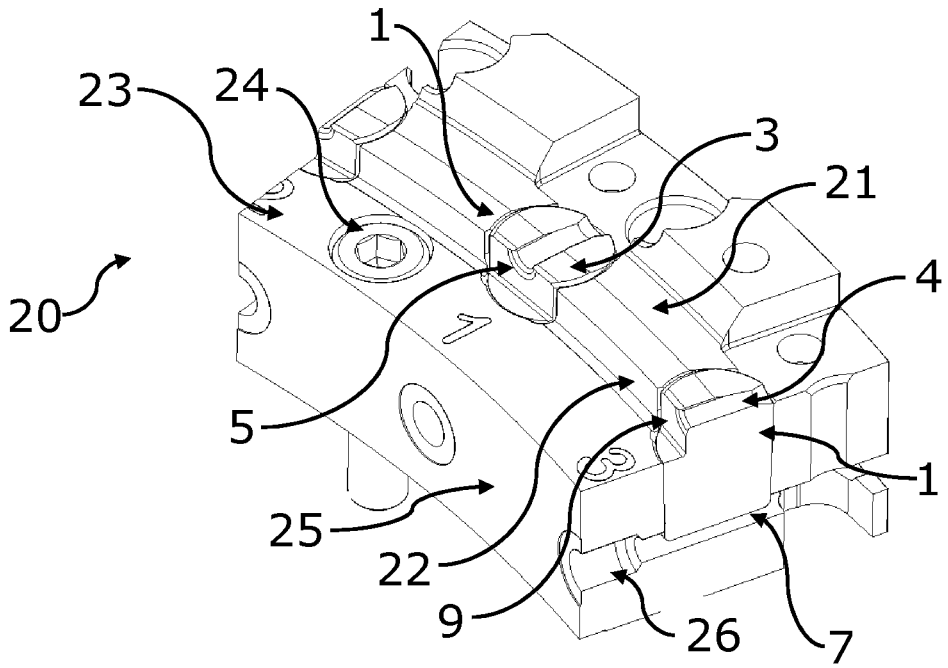
FIG. 3 is a trimetric view of a section of a die holder with a mounted die embodiment.

FIG. 3 is a trimetric view of a section of a die holder 20 with three mounted dies 1. The figure illustrates a section of a rings-shaped die holder 20 with a cross-section view of the die holder 20 and a mounted die 1. The top surface 3 of the die 1 and the top surface part 21 of the die holder 20 are plane in respect to each other. A side surface 22 of the die holder 20 is furthermore plane in respect to the cut-out surface 9 of the die 1, wherein the recess 5 of the die 1 for shaping the head of the elongate body is placed. On a third surface 23 of the die holder 20, parallel to the top surface 21, a pin or bolt 24 is seated for mounting the die holder 20 to a machine (not illustrated). On an inner side 25 of the die holder 20, an opening 26 is located, the opening 26 extending to the bottom surface 7 of the die 1.

Figure 4:
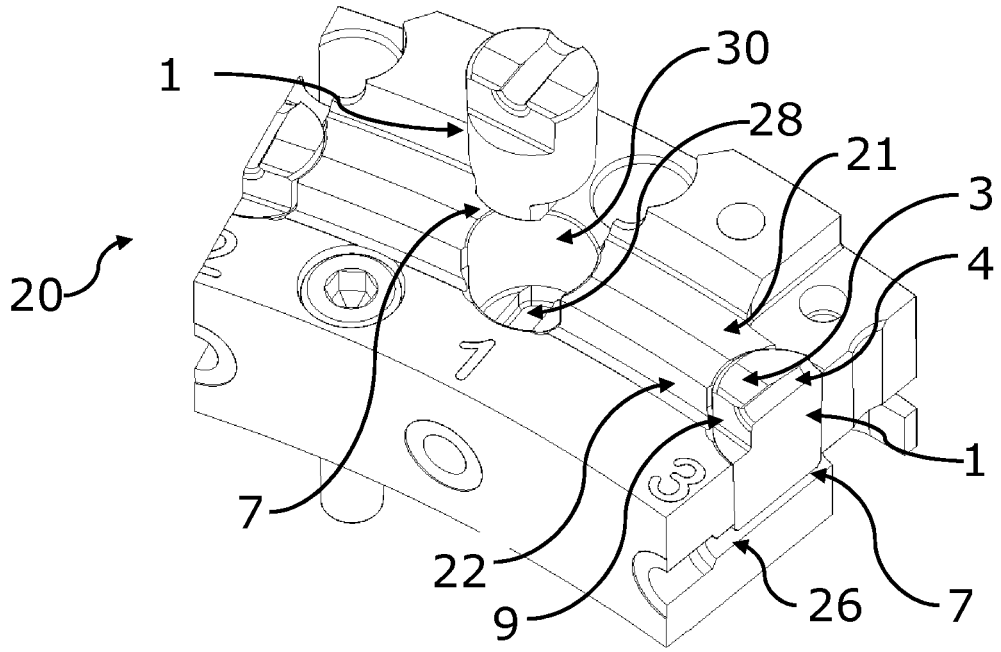
FIG. 4 is a trimetric view of a section of a die holder with an unmounted die embodiment.

FIG. 4 is a trimetric view of a section of a die holder 20 with an unmounted die. The figure illustrates a section of a rings-shaped die holder 20 with a cross-section view of the die holder 20 and a mounted die 1. Furthermore, an unmounted die 1 is floating above a bore 30 in the top surface 21 of the die holder 20. The floating die 1 has a bottom surface 7 corresponding to a bottom surface 28 of the die holder 20. The top surface 3 of the die 1 and the surface part 21 of the die holder 20 are plane in respect to each other when the stop or bottom surface 7 of the die 1 is abutting the bottom surface 28 of the die holder 20.

Figure 5:
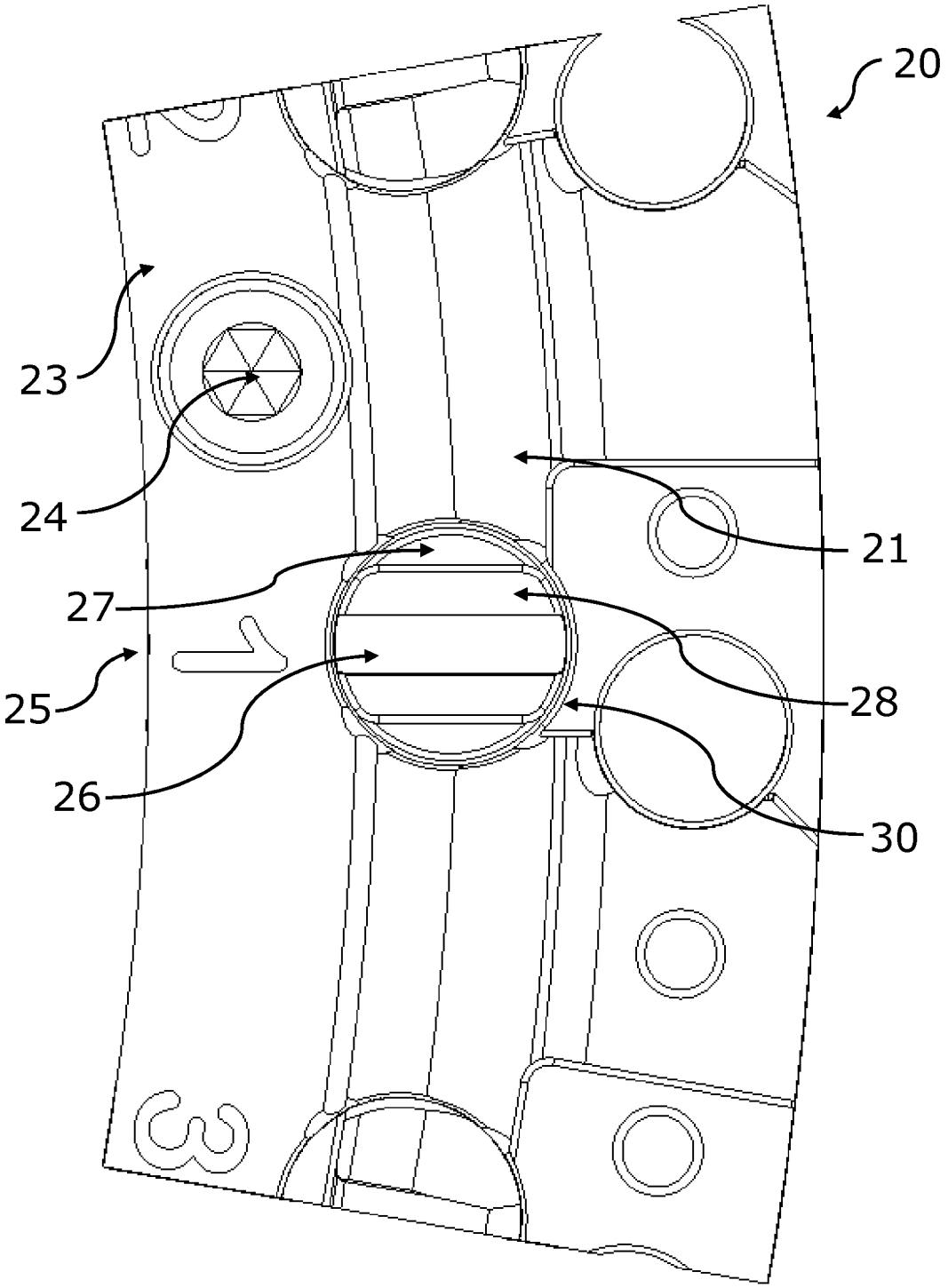
FIG. 5 is a top view of a section of a die holder embodiment.

FIG. 5 is a top view of a section of a ring-shaped die holder 20, according to the invention. In the middle of the figure, the bore 30 in the top surface 21 of the die holder 20 is located. In the bottom of the bore 30, there is a bottom surface 28 and lower shoulder surfaces 27 parallel to each other. Furthermore, in the bottom of the bore, the opening 26 is visible, extending from the inner side 25 of the die holder 20. On a third surface 23 of the die holder 20, parallel to the top surface 21, a pin or bolt 24 is seated for mounting the die holder 20 to a machine (not illustrated).

Figure 6:
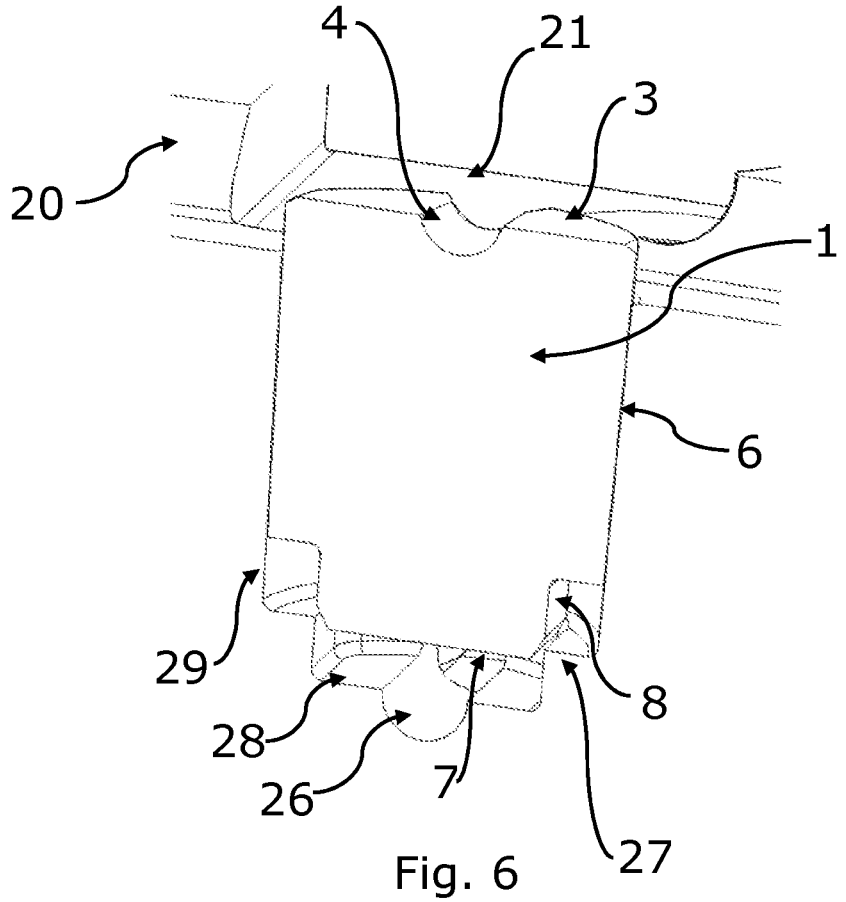
FIG. 6 is a side view of a cross-section of a die holder and die, the die not entirely mounted into the die holder.

FIG. 6 is a side view of a cross-section of a die holder 20 and die 1, the die 1 not entirely mounted into the bore 30 in the die holder 20. The die 1 has a side surface 6 shaped for press fit by contact with an inner surface 29 of the bore 30 in the die holder 20. The press fit serves to interlock the die 1 within the bore 30 of the die holder 20. At the lower portion of the die 1 there are two opposite recesses 8 serving to engage with a lower shoulder surface 27 of the die holder 20, in order to fix angular orientation of the groove 4 relative to the die holder 20. Furthermore, when the bottom surface 7 of the die 1 engage with the bottom surface 28 of the die holder 20, the top surface 3 of the die 1 becomes flush or plane with the top surface 21 of the die holder 20.

Figure 7:
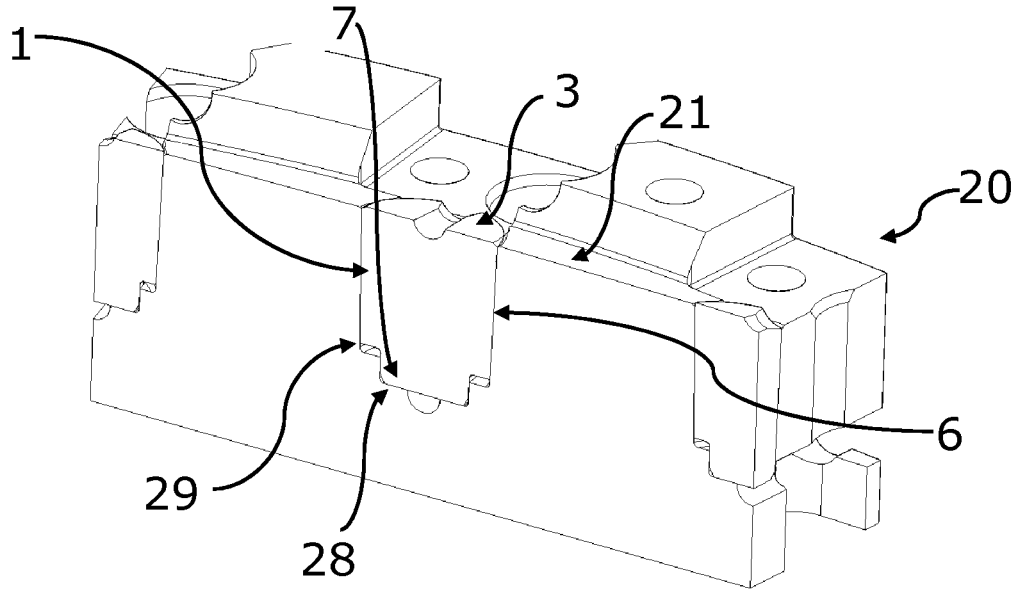
FIG. 7 is a side view of a cross-section of a die holder and die, the die pressed into the die holder.

FIG. 7 is a side view of a cross-section of a die holder 20 and die 1, the die 1 pressed into the die holder 20. The side surface 6 of the die interlocks with the inner surface 29 of the bore and the bottom surface 7 of the die 1 functions as a stop surface for engaging with the bottom surface 28 in the bore of the die holder 20, so as to determine the height of the top surface 3 of the die 1 in relation to the top surface 21 of the die holder 20.

Figure 8:
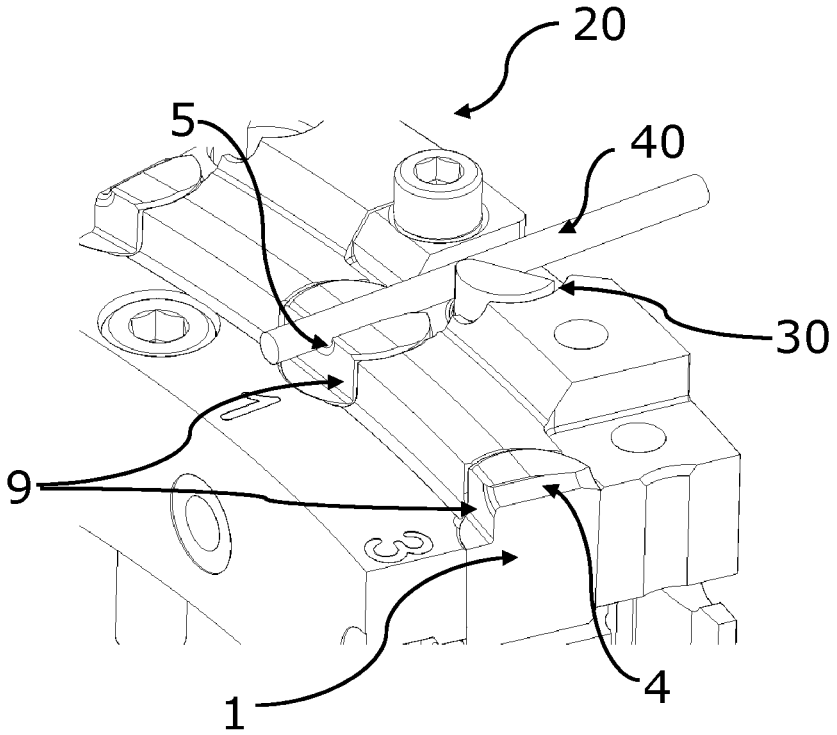
FIG. 8 is a trimetric view of an elongate body fixed in a die and a die holder embodiment.

FIG. 8 is a trimetric view of an elongate body 40 fixed in a die 1 and a ring-shaped die holder 20. The elongate body 40 is placed in the groove 4 of the die 1 and is furthermore locked in place by a locking mechanism 30. Part of the elongate body 40 protrudes at the recess 5 of the cut-out surface 9 of the die 1, seated to be formed onto the head of a nail.

Figure 9:
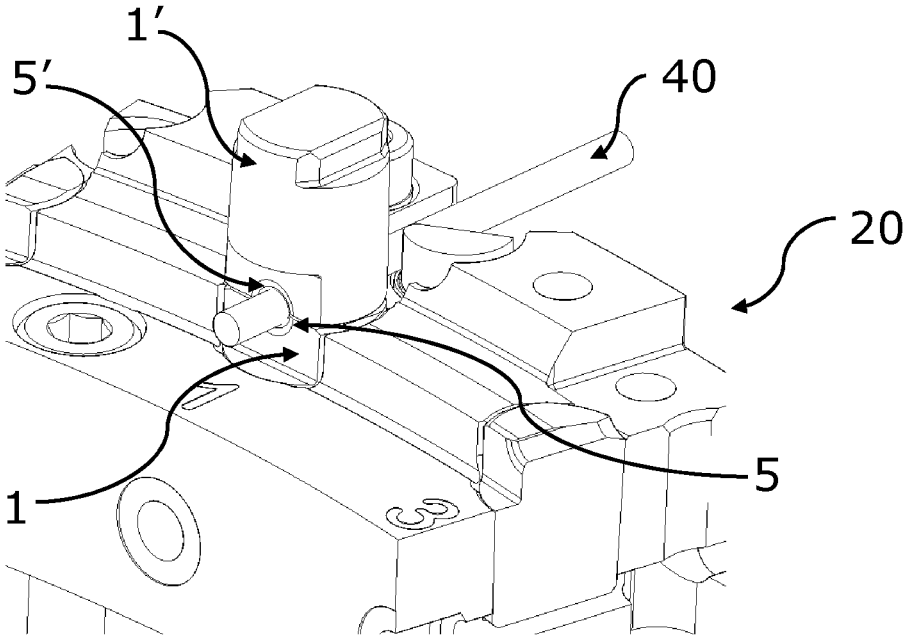
FIG. 9 is a trimetric view of an elongate body fixed between two corresponding dies and a section of a die holder.

FIG. 9 is a trimetric view of an elongate body 40 fixed between two corresponding dies 1, 1' and a section of a ring-shaped die holder 20. The recesses 5, 5' on each die 1, 1' forms the shape of the head of a nail, when the two dies 1, 1' are positioned with their corresponding top surfaces facing towards each other and their grooves aligned.

Figure 10:
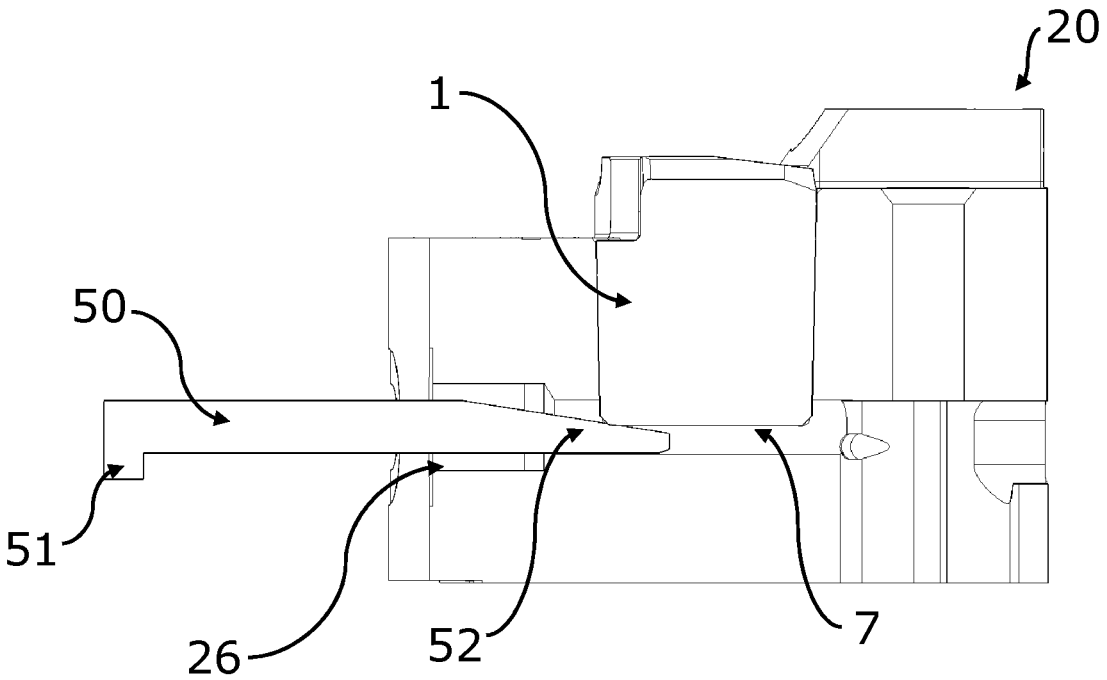
FIG. 10 is a side view of a cross-section of an elongate tool, placed in an opening of a die holder, between the die holder and a die, according to an embodiment.

FIG. 10 is a side view of a cross-section of an elongate tool 50, placed in an opening 26 of a die holder 20, between the die holder 20 and a die 1, according to the invention. The elongate tool has a tapered tip 52 abutting the bottom surface 7 of the die 1. Furthermore, the back end of the elongate tool 50 has a protrusion 51 to indicate to an operator how to orient the elongate tool about a longitudinal axis. When the elongate tool 50 is forced towards the die 1, the die 1 is forced away from the die holder 20, releasing the die 1 from the die holder 20 for maintenance of the die holder 20 or die 1.

Figure 11:
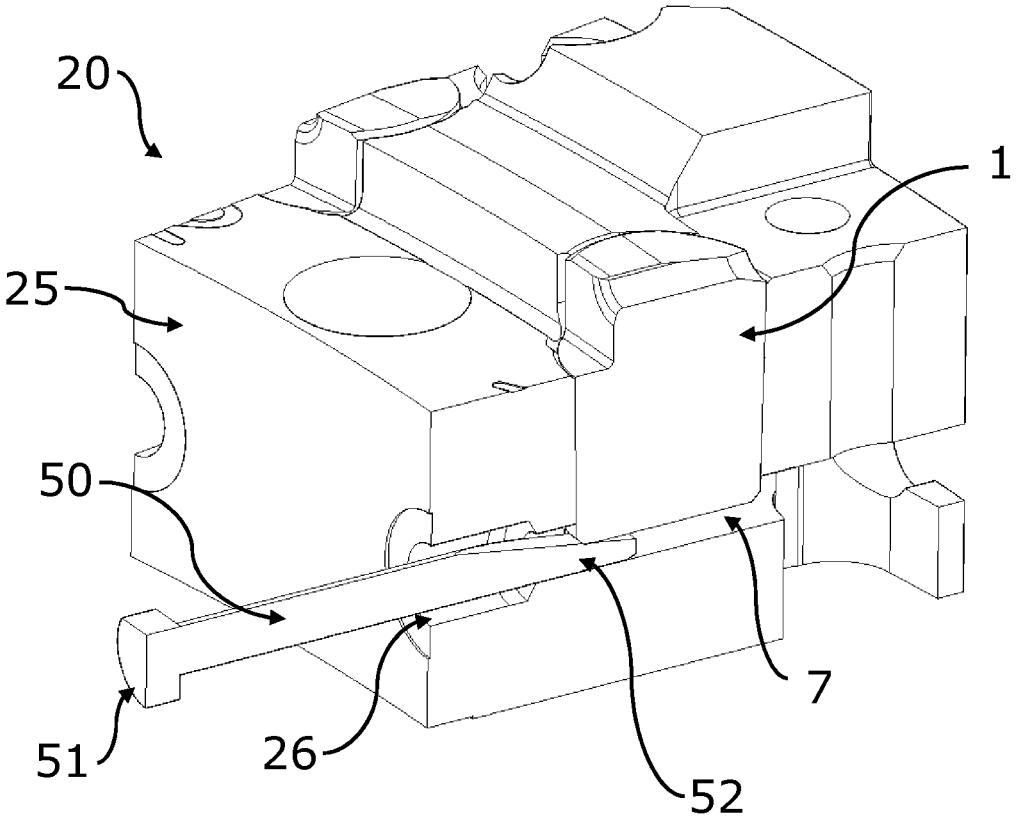
FIG. 11 is a trimetric view of a cross-section of an elongate tool, placed in an opening of a die holder, between the die holder and a die.

FIG. 11 is a trimetric view of a cross-section of an elongate tool 50, placed in an opening 26 on the inner side 25 of a ring-shaped die holder 20, between the die holder 20 and a die 1, according to the invention. When the opening 26 is located at the inner side 25 of the ring-shaped die holder 20, the opening is unobstructed with the die holder 20 mounted for normal operation. The elongate tool 50 has a tapered tip 52 abutting the bottom surface 7 of the die 1. Furthermore, the back end of the elongate tool 50 has a protrusion 51 to indicate to an operator how to orient the elongate tool 50 about a longitudinal axis. When the elongate tool 50 is forced towards the die 1, the die 1 is forced away from the die holder 20, releasing the die 1 from the die holder 20 for maintenance of the die holder 20 or die 1.

Figure 12:
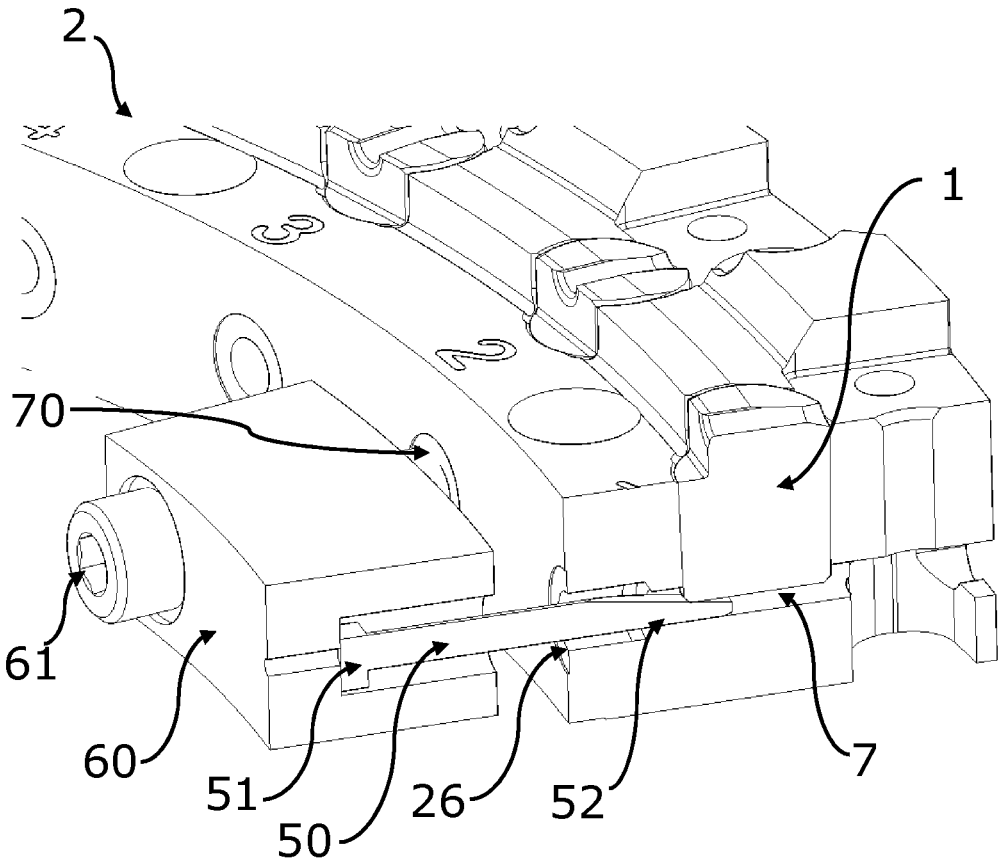
FIG. 12 is a trimetric view of a cross-section of an elongate tool and associated press tool, the press tool mounted on the die holder.

FIG. 12 is a trimetric view of a cross-section of an elongate tool 50 and associated press tool 60, the press tool 60 mounted on the die holder 20, according to the invention. The press tool 60 is mounted through a bolt 61 engaging with a threaded section 70 of a neighbouring opening 26, in relation to the opening 26, which the elongate tool 50 is positioned within. When the press tool 60 is placed on the back end 51 of the elongate tool 50 and the bolt 70 is turned so as to move inwards according to the threading 70, towards the die holder 20, force is applied to the elongate tool 50. As a result, the elongate tool 50 and hence the tapered tip 52 is forced towards the die 1 and the die 1 is forced away from the die holder 20, releasing the die 1 from the die holder 20 for maintenance of the die holder 20 or die 1.

Figure 13:
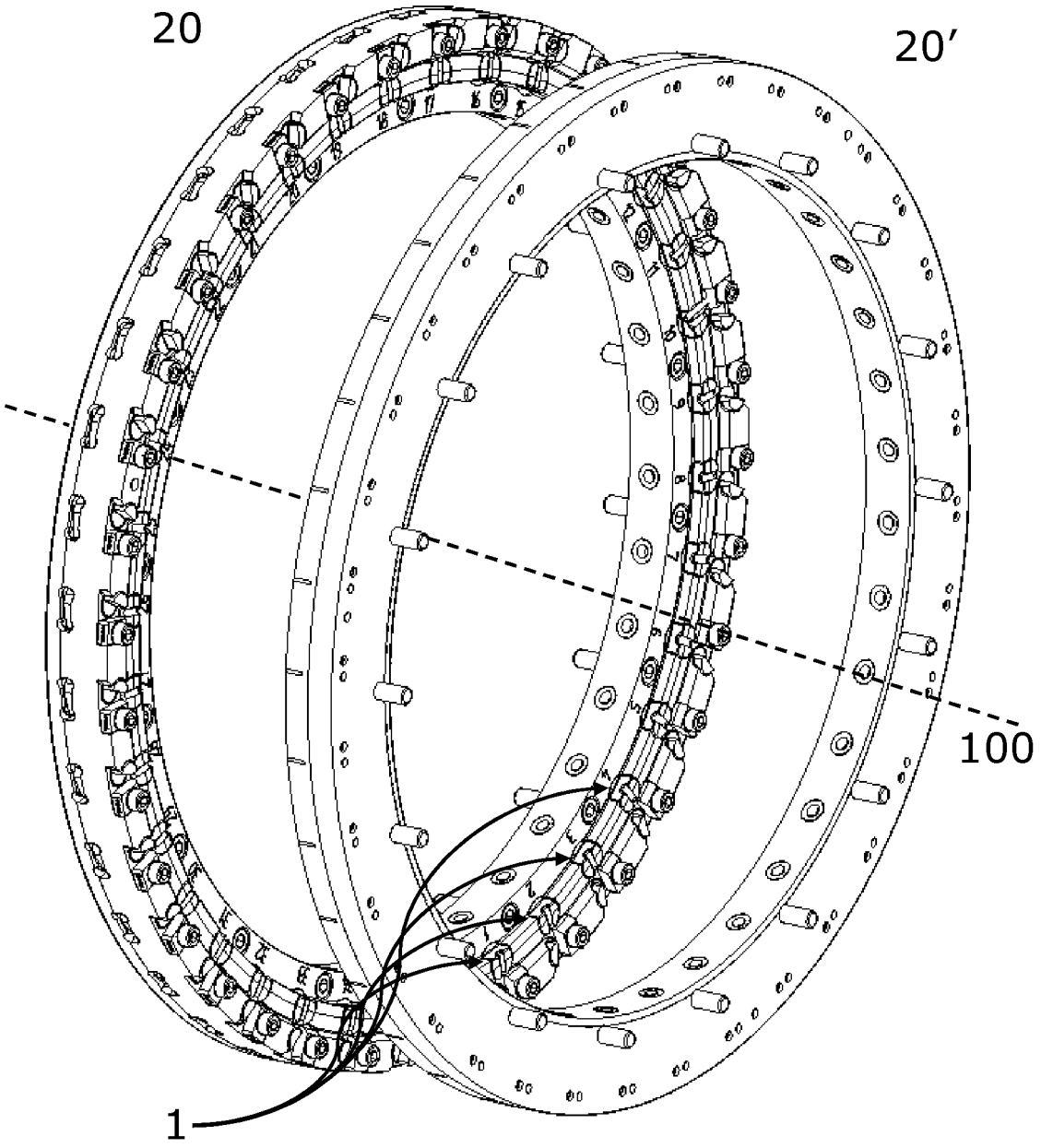
FIG. 13 is a side view of two ring-shaped die holders oriented towards each other, such as for forming part of a nail producing machine.

FIG. 13 is a trimetric view of two ring-shaped die holder embodiments 20, 20' oriented towards each other. The ring-shaped die holders 20, 20' have a central axis of rotation 100, about which they are arranged to rotate. A plurality of dies 1 are positioned within the die holders 20, 20' around the circumference. The dies 1 are mounted on each of the die holders 20, 20' are arranged facing towards each other. Especially, one of the die holders 20, the bores or holes for the dies are parallel with the axis of rotation 100, while on the other die holder 20', the bores or holes for the dies are slightly angled.

Figure 14:
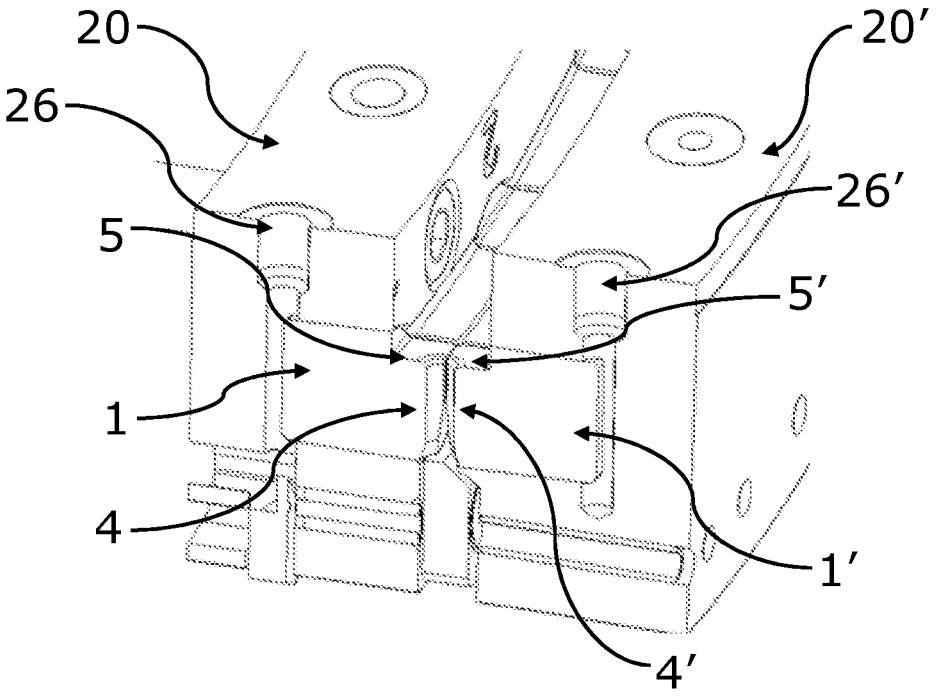
FIG. 14 is a cross-section of a side view of two corresponding dies mounted in two corresponding die holders.

FIG. 14 is a cross-section of a side view of two corresponding dies 1, 1' mounted in two corresponding ring-shaped die holders 20, 20', according to the invention. The dies 1, 1' are aligned with their grooves 4, 4' and recesses 5, 5' facing each other. Furthermore the openings 26, 26' are illustrated, extending towards the dies 1, 1'.

Figure 15:
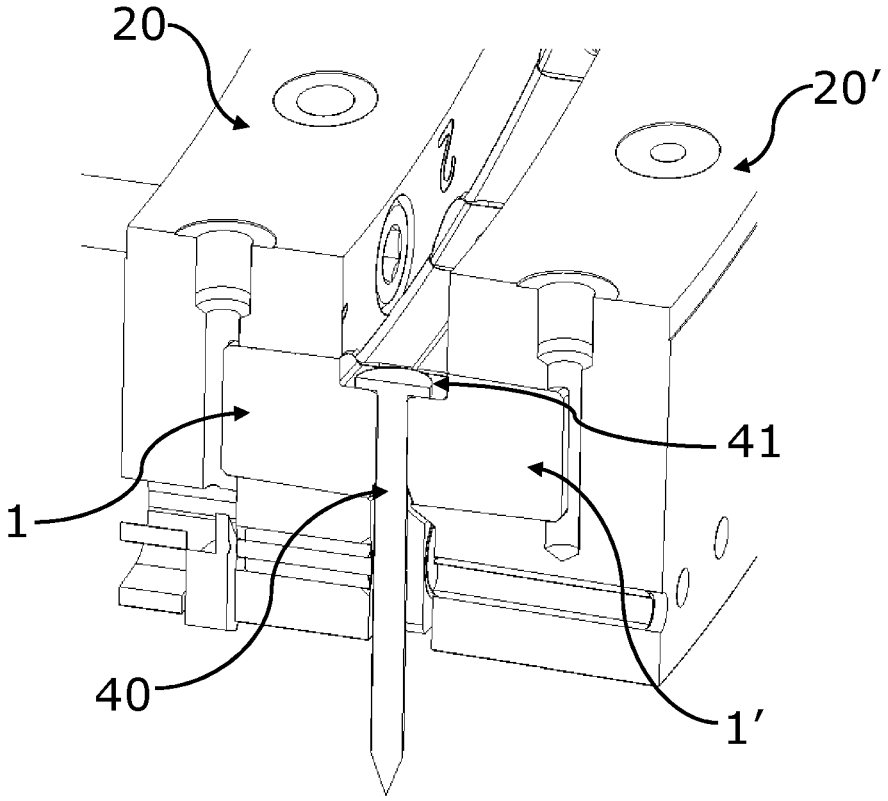
FIG. 15 is a cross-section of a side view of a nail, fixed between two corresponding dies mounted in two corresponding die holders.

FIG. 15 is a cross-section of a side view of an elongate body 40 formed into a nail with a head 41, fixed between two corresponding dies 1, 1' mounted in two corresponding ring-shaped die holders 20, 20', according to the present invention.

Figure 16:
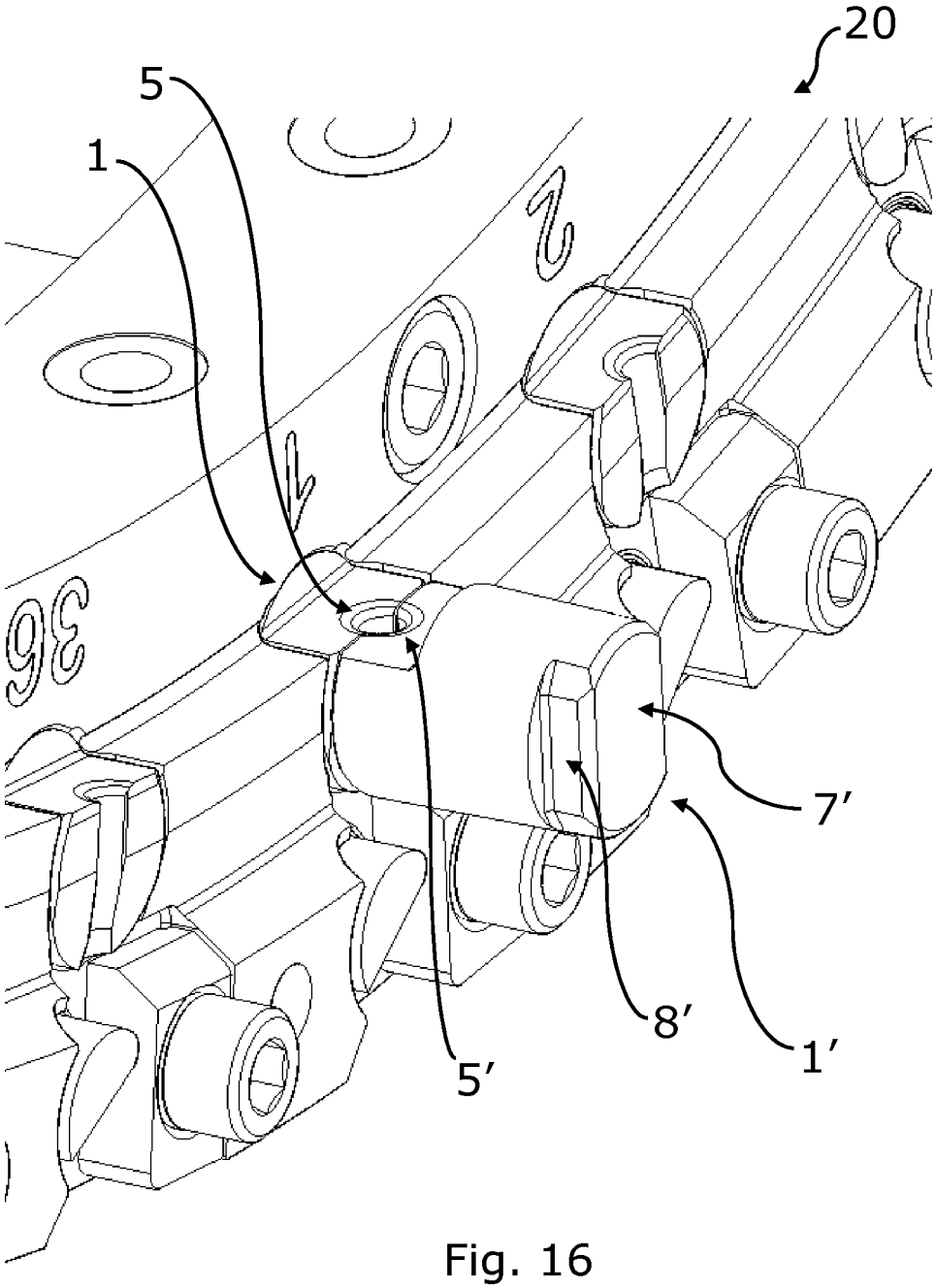
FIG. 16 is trimetric view of a section of a ring-shaped die holder with a mounted die and a corresponding, free-floating die to illustrate cooperation of recesses of two dies for producing a head on a nail.

FIG. 16 is trimetric view of a section of a ring-shaped die holder 20 with a mounted die 1 and a corresponding, free-floating die 1'. The two opposing dies 1, 1' form the head of a nail with their corresponding recesses 5, 5'. The figure illustrates how the die 1 is seated in the die holder 20 by observing the visible bottom surface 7' of the floating die 1' and the recess 8' shaped to ensure angular fixation of the groove on the top surface of the die 1'.

Figures 17A, 17B, 17C:
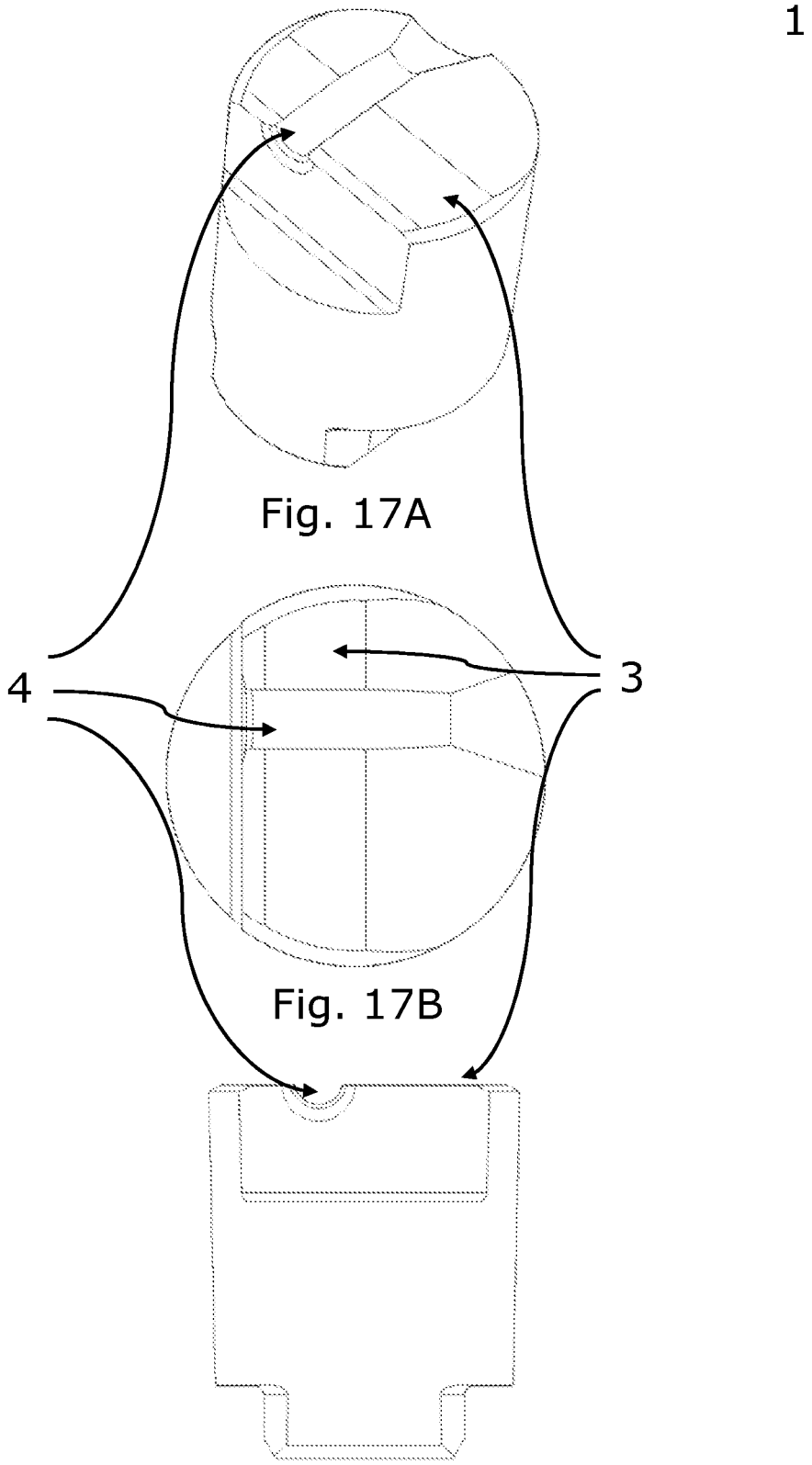
FIGS. 17A, 17B and 17C show three different views of an alternative die.

FIG. 17 shows three different views of an alternative die embodiment, where the groove is offset from a longitudinal axis through the body of the die from top surface 3 to bottom of the die body. FIG. 17A is a trimetric view of a die 1, the die 1 having a groove 4 which is off-center in relation to the top surface 3 of the die 1. FIG. 17B is a top view of a die 1, the die 1 having a groove 4 which is off-center in relation to the top surface 3 of the die 1. FIG. 17C is a side view of a die 1, the die 1 having a groove 4 which is off-center in relation to the top surface 3 of the die 1.

Figure 18:
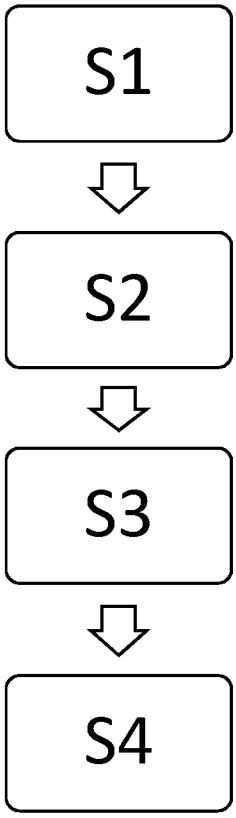
FIG. 18 is a flow-chart of a method according to the invention.

FIG. 18 is a flow-chart of a method embodiment for manufacturing a head on an elongate body, such as metal nails or screws, the method comprising:

S1 providing first and second die holders, each of the first and second die holders comprising:

1. a body having at least a substantially plane top surface part,
2. a hole or bore in the substantially plane top surface part, wherein the hole or bore has an inner surface shaped for receiving the die and for press fit by contact with a side surface of the die,
3. a stop part located in the hole or bore for engaging with a bottom surface of the die when being pressed into the hole or bore, so as to fix a height of the top surface of the die in relation to the top surface part of the die holder, and
4. a protrusion or recess serving to engage with a corresponding recess or protrusion of the die, in order to fix angular orientation of the groove of the die relative to the die holder.

S2 providing first and second dies, each of the first and second dies comprising:

1. a body with a top surface provided with a through-going groove for receiving and holding an elongate body longitudinally in said groove,
2. a recess at one end of the groove suitable for forming the head on the elongate body,
3. a side surface shaped for press fit by contact with an inner surface of a bore or hole in the associated die holder,
4. a bottom surface for engaging with a stop part in the hole or bore of the associated die holder, so as to determine a height of the top surface of the die in relation to a surface part of the associated die holder, and 5. a recess or protrusion serving to engage with a corresponding protrusion or recess of the associated die holder, in order to fix angular orientation of the groove relative to the die holder, S3 bringing the top surface of the first die so near to the top surface of the second die that the grooves of the first and second dies hold the elongate body, and S4 providing force onto the elongate body at the recess end of the grooves so as to form a head on the elongate body.

In a further embodiment, the method may comprise the step of removing the die by pushing a bottom part of the die, such as by a dedicated tool, through an opening in the die holder.

Figure 19:
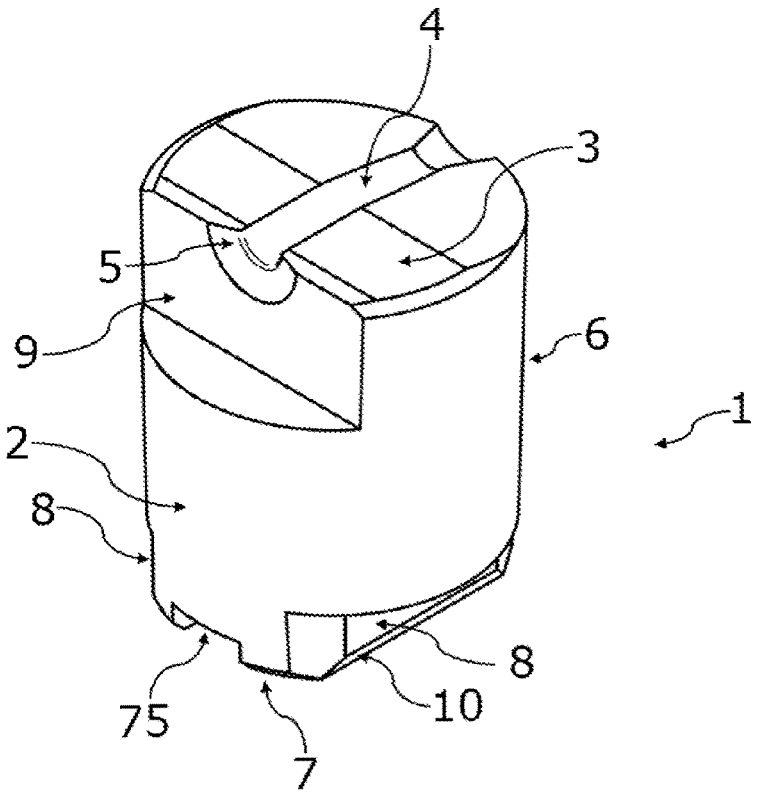
FIG. 19 is a trimetric view of a die embodiment with a groove at a bottom surface.

FIG. 19 is a trimetric view of a die 1 embodiment with a groove 75 at a bottom surface 7. The figure illustrates a die 1 for mounting in an associated die holder for the production of heads on elongate bodies, such as a metal nail or screw. The die 1 comprises a body 2 with a top surface 3. The top surface has a through-going groove 4 suitable for receiving and holding the elongate body longitudinally in the groove 4. The groove 4 may have gripper marks (not visible) for increased friction with the elongate body to improve the holding effect. The body 2 of the die 1 has a cut-out surface 9 on one side and the cut-out surface 9 has a recess 5, which extends from the cut-out surface 9 and merges into the groove 4. The recess 5 is shaped to form half of the head on the elongate body. The die 1 has a side surface 6 shaped for press fit by contact with an inner surface of a bore or hole in the associated die holder. The die 1 has a bottom surface 7 with a chamfer 10 for easy mounting of the die 1 into the hole or bore of the associated die holder. At the lower portion of the body 2 there are two opposite recesses 8 serving to engage with a corresponding protrusion of the associated die holder, in order to fix angular orientation of the groove 4 relative to the die holder.

On the bottom surface 7, a groove 75 has been cut into the body 2 of the die 1. The purpose of this groove 75 is to allow an elongate tool with a tip matching the groove 75 to engage with the groove in order to push the die 1 upwards, when press fit mounted in a die holder. Especially, such elongate tool can be inserted in an opening in the die holder and thus facilitate removing the die for replacement.

Figure 20:
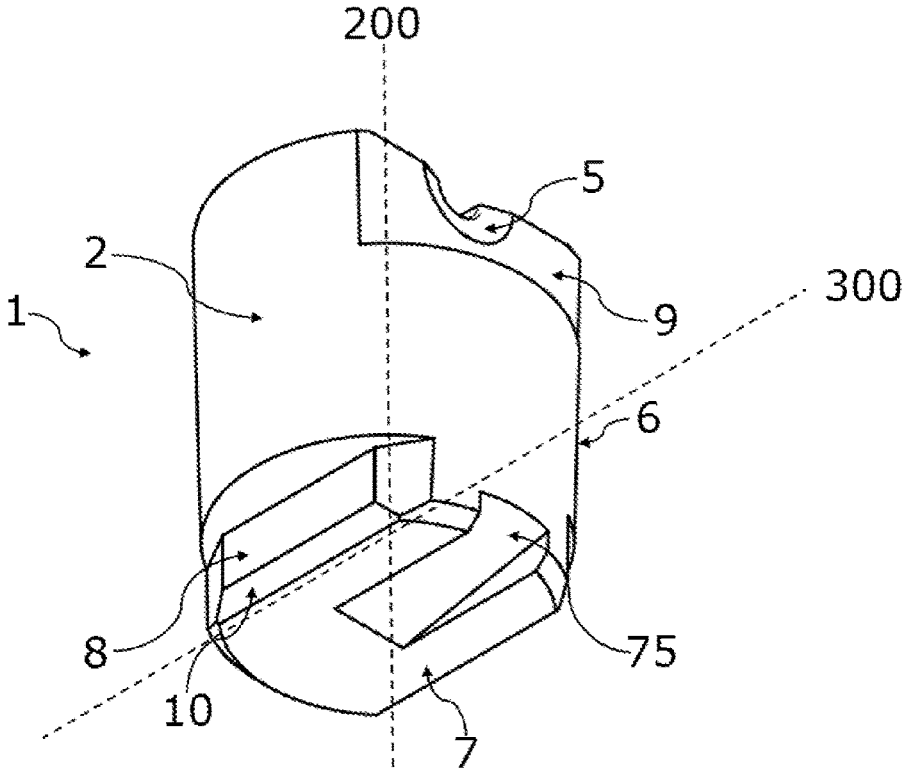
FIG. 20 is another trimetric view of a die embodiment with a groove at a bottom surface.

FIG. 20 is another trimetric view of a die 1 embodiment with a groove 75 at a bottom surface 7. The figure illustrates a die 1 for mounting in an associated die holder for the production of heads on elongate bodies, such as a metal nail or screw. The die 1 comprises a body 2 with a cut-out surface 9 on one side and the cut-out surface 9 has a recess 5, which extends from the cut-out surface 9. The recess 5 is shaped to form half of the head on the elongate body. The die 1 has a side surface 6 shaped for press fit by contact with an inner surface of a bore or hole in the associated die holder. The die 1 has a bottom surface 7 with a chamfer 10 for easy mounting of the die 1 into the hole or bore of the associated die holder. At the lower portion of the body 2 there are two opposite recesses 8 (one recess not shown) serving to engage with a corresponding protrusion of the associated die holder, in order to fix angular orientation of the groove 4 relative to the die holder.

On the bottom surface 7, an inclined groove 75 has been cut into the body 2 of the die 1. In the present embodiment, the inclined groove 75 is a plane surface being parallel with an axis 300 perpendicular to a central axis/length axis 200 of the die 1. The angle of inclination is preferably 2°-20°. The inclined plane surface helps to provide a force in an upward direction to drive out the die 1 from a die holder. The tool preferably has a tip with an inclination angle matching the inclination angle of the plane surface of the groove 75. An example of such tool will be given below.

Figure 21:
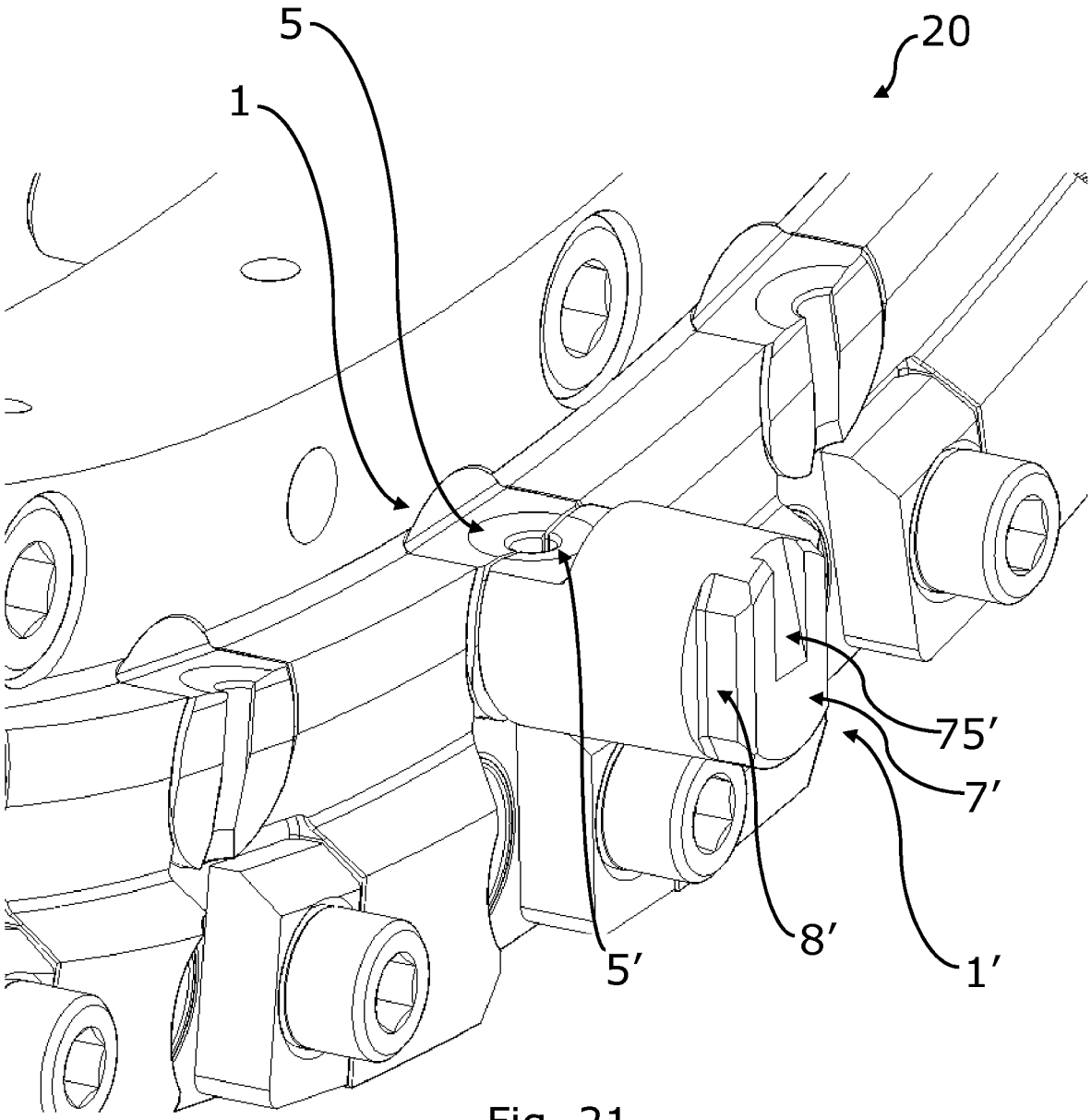
FIG. 21 is trimetric view of a section of a ring-shaped die holder with a mounted die and a corresponding, free-floating die, with an inclined groove to illustrate cooperation of recesses of two dies for producing a head on a nail.

FIG. 21 is trimetric view of a section of a ring-shaped die holder with a mounted die and a corresponding, free-floating die, with an inclined groove to illustrate cooperation of recesses of two dies for producing a head on a nail. The two opposing dies 1, 1' form the head of a nail with their corresponding recesses 5, 5'. The figure illustrates how the die 1 is seated in the die holder 20 by observing the visible bottom surface 7' of the floating die 1' and the recess 8' shaped to ensure angular fixation of the groove on the top surface of the die 1'. On the bottom surface 7 of the floating die 1', an inclined groove 75' is visible, i.e. a groove 75' with the functionality as explained for the groove 75 above.

Preferably, the die holder 20 is a monolithic element made of metal, preferably a metal which is softer than the metal or other material which forms the associated dies to be press fit in the holes or bores 30. The dies are preferably made of a hard material, e.g. a hard metal, to provide a long life time. By the press fitting principle, the hard material die is securely fastened in the hole or bore 30, thus providing optimal support of the edge of the hard material die, thereby providing a long life time of the die.

The holes or bores 30 each has an inner surface shaped for receiving a die and for press fit by contact with the side surface of the die. In the hole or bore 30, a stop part is formed so as to allow engagement with a stop surface of the die when the die is being pressed into the hole or bore, so as to fix a height of a top surface of the die in relation to the top surface part of the die holder 20. Further, the die holder 20 has a protrusion or recess serving to engage with a corresponding recess or protrusion of the die, in order to fix angular orientation of the die relative to the die holder, thereby facilitating precise angular orientation of the die during the mounting in the die holder 20, e.g. after replacement of the die.

Examples of the stop part and protrusion or recess for angular orientation fixing of the die can be seen in FIGS. 4-7. These features may be made in the die holder 20 by a milling process in the hole or bore 30.

Figure 22:
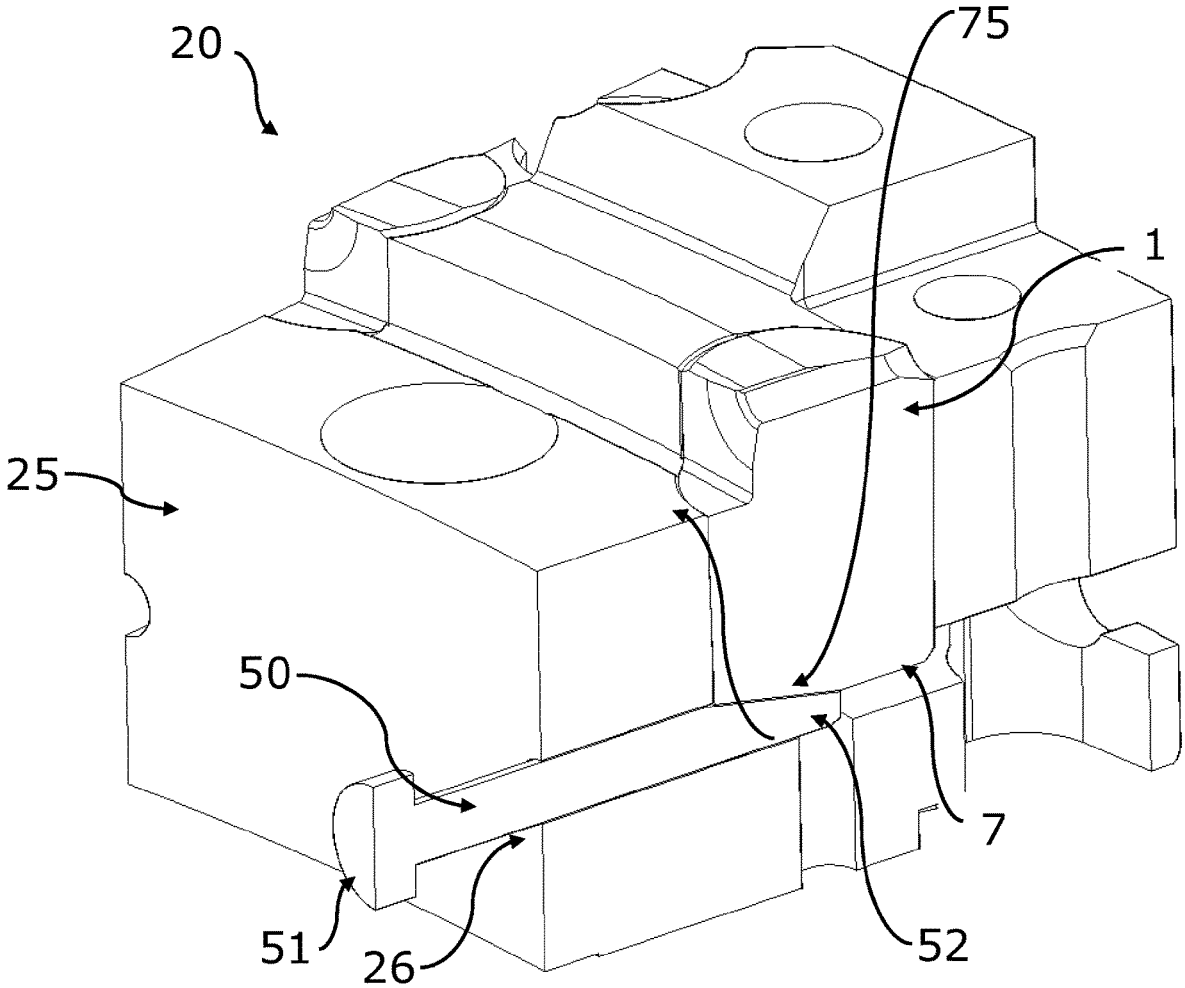
FIG. 22 is a trimetric view of a cross-section of an elongate tool, placed in an opening of a die holder, between the die holder and a die with an inclined groove at the bottom surface.

FIG. 22 is a trimetric view of a cross-section of an elongate tool 50, placed in an opening 26 on the inner side 25 of a ring-shaped die holder 20, between the die holder 20 and a die 1, according to the invention. When the opening 26 is located at the inner side 25 of the ring-shaped die holder 20, the opening is unobstructed with the die holder 20 mounted for normal operation. The elongate tool 50 has an inclined tip 52 abutting a corresponding inclined groove 75 on the bottom surface 7 of the die 1. Furthermore, the back end of the elongate tool 50 has a protrusion 51 to indicate to an operator how to orient the elongate tool 50 about a longitudinal axis. When the elongate tool 50 is forced towards the die 1, the die 1 is forced away from the die holder 20, releasing the die 1 from the die holder 20 for maintenance of the die holder 20 or die 1.

Figure 23:
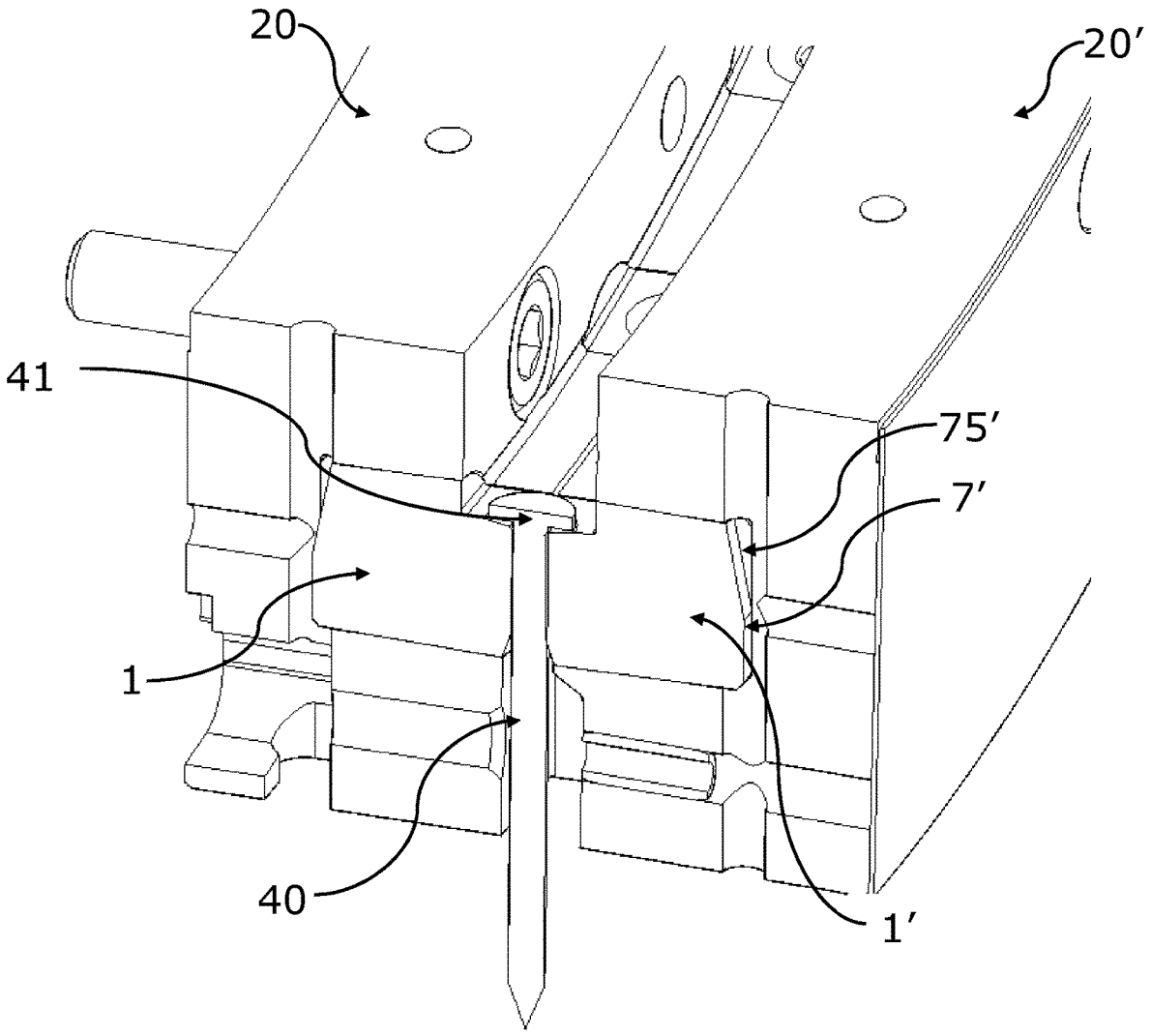
FIG. 23 is a cross-section of a side view of an elongate body formed into a nail with a head, fixed between two corresponding dies with an inclined groove at the bottom surface.

FIG. 23 is a cross-section of a side view of an elongate body 40 formed into a nail with a head 41, fixed between two corresponding dies 1, 1' mounted in two corresponding ring-shaped die holders 20, 20', according to the present invention. On the bottom surface 7' of the die 1', an inclined groove 75' is visible.

Figure 24:
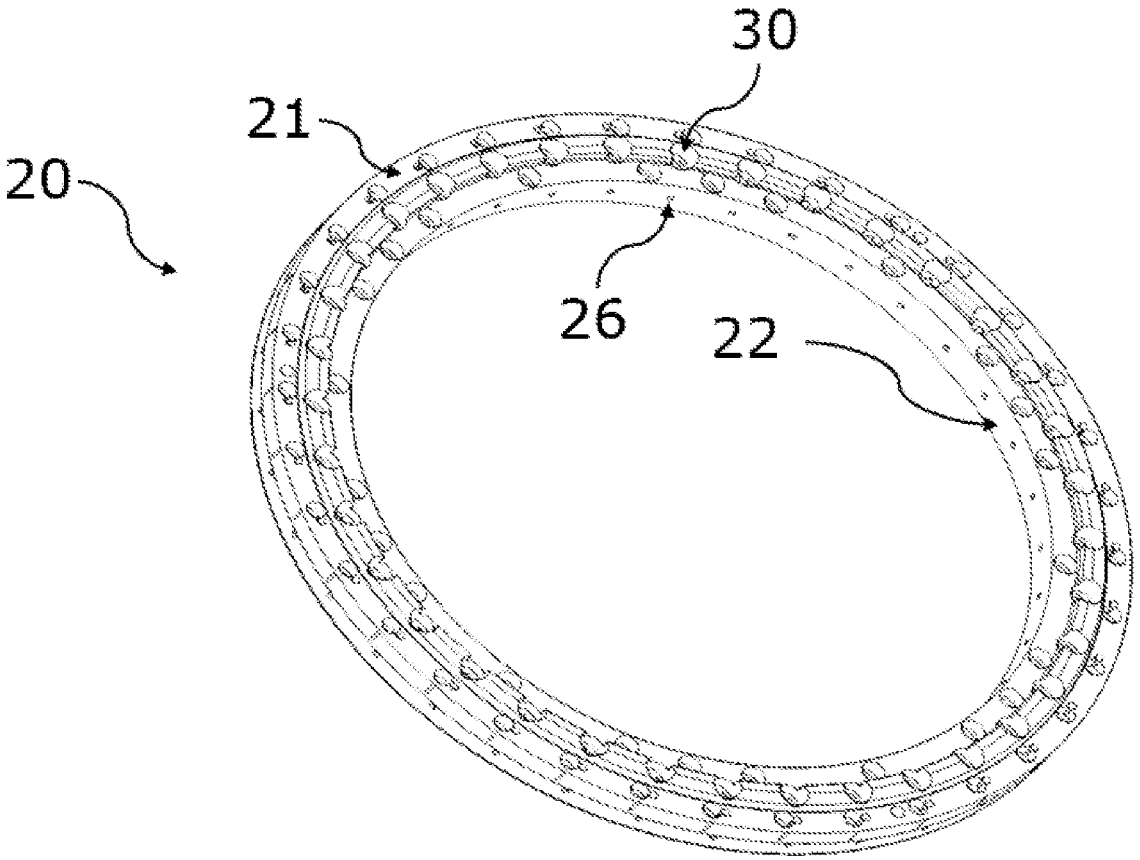
FIG. 24 is a trimetric view of a die holder embodiment in the form of a tool ring for a nail producing machine for holding 36 dies.

FIG. 24 is a trimetric view of an embodiment of a die holder 20 in the form of a ring shaped tool ring for a nail manufacturing machine. The die holder 20 comprises a top surface 21 with a plurality of evenly distributed holes or bores 30 each formed to receive a die shaped for press fit mounting. The die holder 20, further comprises a side surface 22 with openings 26, corresponding to each of the holes or bores 30. These openings 26 serve to insert an elongate tool for removing the dies when press fit mounted in the holes or bores 30.

Figure 25:
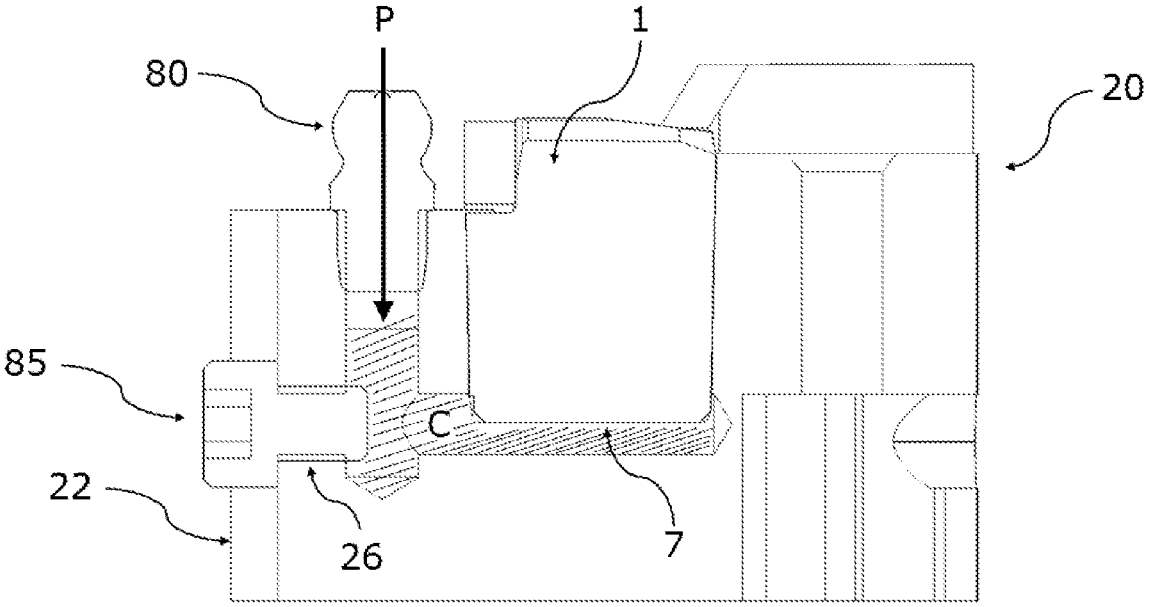
FIG. 25 is a side view of a cross-section of a die holder and die, the die pressed into the die holder with a bushing attached to the die holder.

FIG. 25 is a side view of a cross-section of a die holder 20 and die 1, the die 1 being pressed into the die holder 20 with a bushing 80 attached to the die holder 20. In order to remove the die 1 from the die holder 20, a hydraulic pressure P may be applied into a cavity C within the die holder 20, so as to eject the die 1 from said die holder 20. In order to contain the hydraulic pressure P within the cavity C, a plug 85 has been inserted into the opening 26 in the side surface 22 of the die holder 20.

Figure 26:
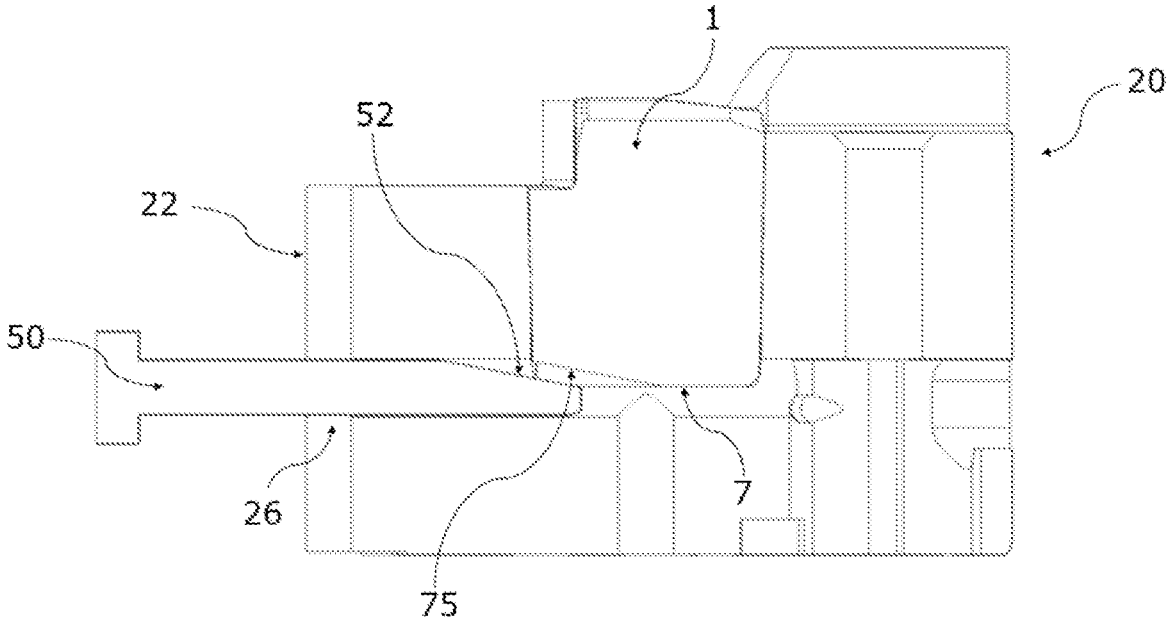
FIG. 26 is a side-view of a cross-section of an elongate tool, placed in an opening of a die holder.

FIG. 26 is a side-view of a cross-section of an elongate tool 50, placed in an opening 26 of a die holder 20. The elongate tool 50 is inserted through the opening 26 of a side surface 22 of said die holder 20 and the figure illustrates how the inclined tip 52 on the elongate tool 50 corresponds to the inclination of the groove 75 on the bottom surface 7 of the die 1. In this way the elongate tool 50 can apply an upwards force on the die 1 based on a wedge principle.

Figure 27:
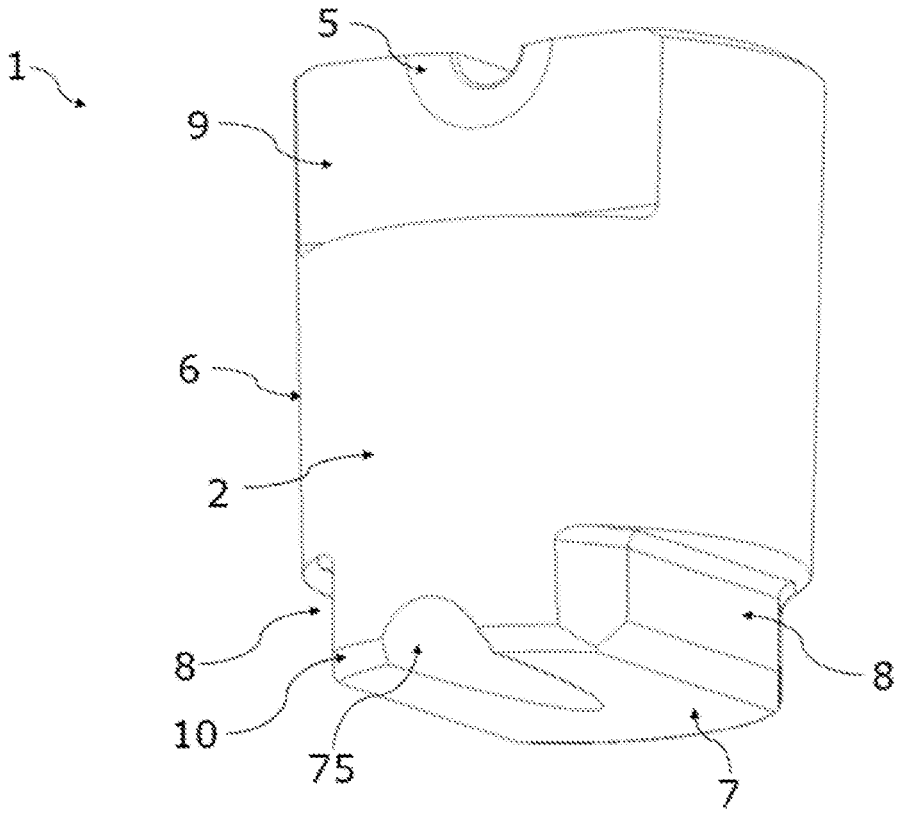
FIG. 27 is a trimetric view of a die embodiment with a rounded groove at a bottom surface.
Figure 28:
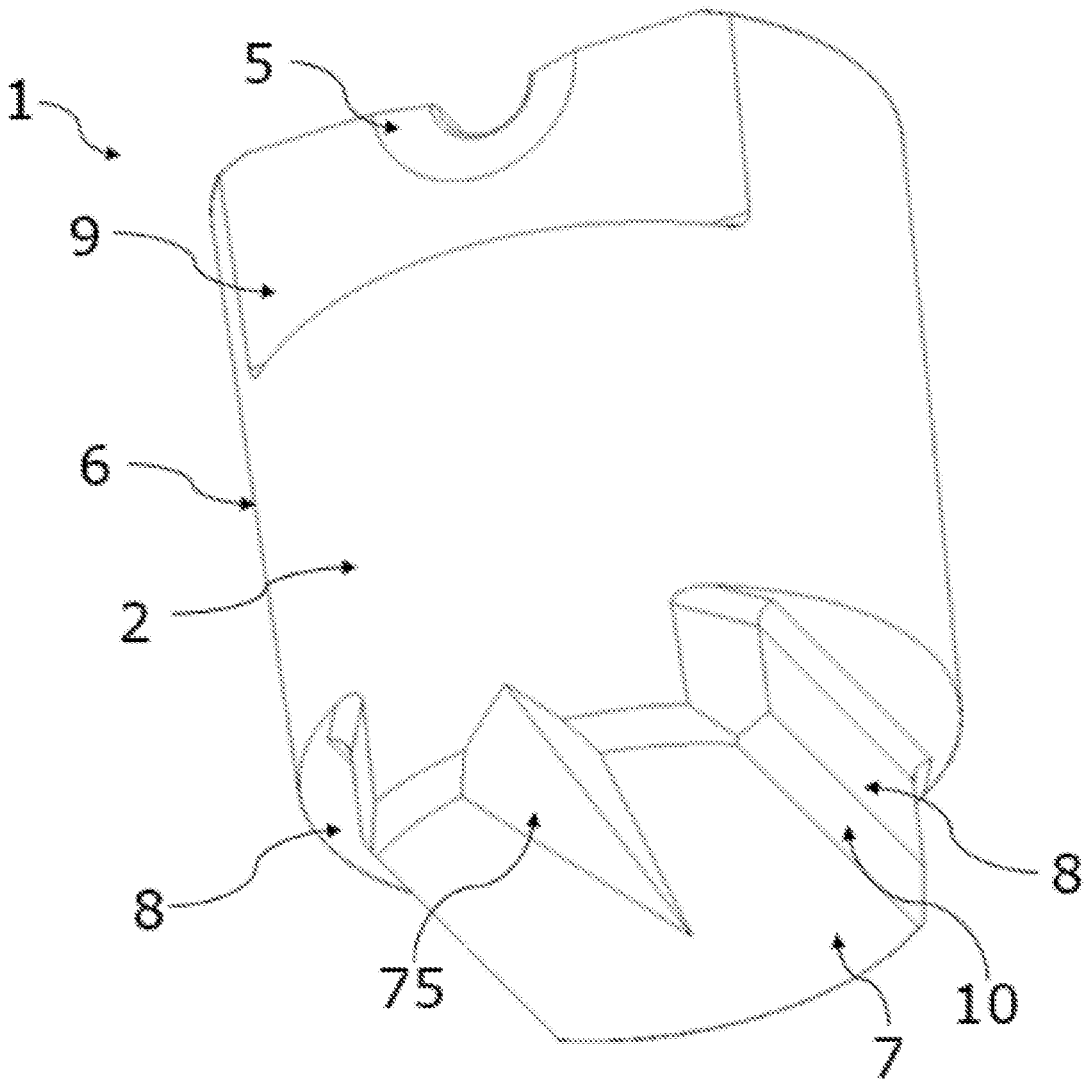
FIG. 28 is a trimetric view of a die embodiment with a v-shaped groove at a bottom surface.

FIGS. 27 and 28 serve to illustrate other examples of shapes of the groove 75 than the plane groove shape shown above. Preferably, as already described, an elongate tool for removing the die has a tip shaped to match the shape of the groove 75 of the die embodiments in FIGS. 27 and 28, i.e. rounded or v-shaped.

FIG. 27 is a trimetric view of a die 1 embodiment with a rounded groove 75 at a bottom surface 7. The figure illustrates a die 1 for mounting in an associated die holder for the production of heads on elongate bodies, such as a metal nail or screw. The die 1 comprises a body 2 with a cut-out surface 9 on one side and the cut-out surface 9 has a recess 5, which extends from the cut-out surface 9. The recess 5 is shaped to form half of the head on the elongate body. The die 1 has a side surface 6 shaped for press fit by contact with an inner surface of a bore or hole in the associated die holder. The die 1 has a bottom surface 7 with a chamfer 10 for easy mounting of the die 1 into the hole or bore of the associated die holder. At the lower portion of the body 2 there are two opposite recesses 8 serving to engage with a corresponding protrusion of the associated die holder, in order to fix angular orientation of the groove 4 relative to the die holder. On the bottom surface 7, a rounded groove 75 has been cut into the body 2 of the die 1. The purpose of this groove 75 is to allow an elongate tool with a rounded tip matching the rounded groove 75 to engage with the groove in order to push the die 1 upwards, when press fit mounted in a die holder.

FIG. 28 is a trimetric view of a die 1 embodiment with a v-shaped groove 75 at a bottom surface 7. The figure illustrates a die 1 for mounting in an associated die holder for the production of heads on elongate bodies, such as a metal nail or screw. The die 1 comprises a body 2 with a cut-out surface 9 on one side and the cut-out surface 9 has a recess 5, which extends from the cut-out surface 9. The recess 5 is shaped to form half of the head on the elongate body. The die 1 has a side surface 6 shaped for press fit by contact with an inner surface of a bore or hole in the associated die holder. The die 1 has a bottom surface 7 with a chamfer 10 for easy mounting of the die 1 into the hole or bore of the associated die holder. At the lower portion of the body 2 there are two opposite recesses 8 serving to engage with a corresponding protrusion of the associated die holder, in order to fix angular orientation of the groove 4 relative to the die holder. On the bottom surface 7, a v-shaped groove 75 has been cut into the body 2 of the die 1. The purpose of this groove 75 is to allow an elongate tool with a corresponding v-shaped tip matching the v-shaped groove 75 to engage with the groove in order to push the die 1 upwards, when press fit mounted in a die holder.

To sum up, the invention provides a die (1) for mounting in an associated die holder (20) for the production of heads on elongate bodies such as nails or screws. The die has a body (2) with a top surface (3) provided with a through-going groove (4) for receiving and holding an elongate body longitudinally in said groove. Furthermore, the die has a recess in the form of a cut-out (9) on one side merging into the groove (4) at one end of the groove (4) suitable for forming the head of a nail or screw. The die is preferably shaped tapered or conical for press fit by contact with the inner surface of a bore or hole (30) in the associated die holder. The top surface (3) of the die (1) is plane in relation to the top surface (21) of the die holder (20) through a stop or bottom surface (7) which engages with a stop or bottom part (28) within the hole or bore (30) of the die holder (20). Furthermore, the bottom portion of the die has at least one recess (8) or protrusion serving to engage with a corresponding protrusion (27) or recess of the associated die holder, in order to fix angular orientation of the groove (4) relative to the die holder (20). In order to produce a nail or screw from an elongate body (40), two opposite dies are brought together by two opposite die holders, the dies together forming the head (41) with their combined recesses.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A method of forming a manufacture comprising:

mounting a die in an associated die holder for the production of heads on elongate bodies, receiving and holding an elongate body longitudinally in a groove through a top surface of the die, forming a head on the elongate body at a recess of one end of the groove, press fitting a side surface of the die by contact with an inner surface of a bore or hole in the associated die holder, engaging a stop surface of the die with a stop part in the hole or bore of the associated die holder, so as to determine a height of the die in relation to the associated die holder, and engaging a recess or protrusion of the die with a corresponding protrusion or recess of the associated die holder, in order to fix angular orientation of the groove relative to the die holder.

2. The method of claim 1 further comprising guiding the die into the corresponding protrusion or recess of the associated die holder in accordance with a fixed angular orientation of the recess or protrusion.

3. The method of claim 1 further comprising guiding the die into the associated die holder in accordance with a shoulder formed from at least one recess, wherein the recess has a corresponding protrusion within said die holder, in order to fix angular orientation of the groove relative to the associated die holder.

4. The method of claim 1 further comprising engaging the stop surface including at least one surface on a lower part of the die with a bottom surface or lower shoulder surface in the hole or bore of the associated die holder.

5. A manufacture comprising:

a die for mounting in an associated die holder for the production of heads on elongate bodies, the die having a substantially cylindrical shape and including:

a body with a top surface provided with a through-going groove for receiving and holding an elongate body longitudinally in said groove, a recess at one end of the groove configured to form a head on the elongate body, a side surface shaped for press fit by contact with an inner surface of a bore or hole in the associated die holder, a stop surface for engaging with a stop part in the hole or bore of the associated die holder, so as to fix a height of the die in relation to the associated die holder, and a recess or protrusion configured to engage a corresponding protrusion or recess of the associated die holder to fix angular orientation of the groove relative to the die holder.

6. The manufacture according to claim 1, wherein the groove is perpendicular or substantially perpendicular to a central longitudinal axis through the body of the die from the top surface to a bottom part of the body of the die.

7. The manufacture according to claim 1, wherein the recess or protrusion is further configured to fix angular orientation is shaped so as to guide the die into the corresponding protrusion or recess of the associated die holder.

8. The manufacture according to claim 1, wherein at least a part of the body is tapered.

9. The manufacture according to claim 5, including at least one die guide recess.

10. The manufacture according to claim 1, wherein the stop surface comprises at least one surface on a lower part of the body for engaging with a corresponding surface in the hole or bore of the associated die holder.

11. A manufacture comprising:

a die for mounting in an associated die holder for the production of heads on elongate bodies, the die having a substantially cylindrical shape and including:

a body with a top surface provided with a through-going groove for receiving and holding an elongate body longitudinally in said groove, a recess at one end of the groove configured to form a head on the elongate body, a side surface shaped for press fit by contact with an inner surface of a bore or hole in the associated die holder, a stop surface for engaging with a stop part in the hole or bore of the associated die holder, so as to fix a height of the die in relation to the associated die holder, and a recess or protrusion configured to engage a corresponding protrusion or recess of the associated die holder to fix angular orientation of the groove relative to the die holder, and wherein at least a part of the body has a conical shape.

12. A manufacture comprising:

a die for mounting in an associated die holder for the production of heads on elongate bodies, the die having a substantially cylindrical shape and including:

a body with a top surface provided with a through-going groove for receiving and holding an elongate body longitudinally in said groove, a recess at one end of the groove configured to form a head on the elongate body, a side surface shaped for press fit by contact with an inner surface of a bore or hole in the associated die holder, a stop surface for engaging with a stop part in the hole or bore of the associated die holder, so as to fix a height of the die in relation to the associated die holder, and a recess or protrusion configured to engage a corresponding protrusion or recess of the associated die holder to fix angular orientation of the groove relative to the die holder;

wherein the die has one or more holes or bores in a bottom surface configured to engage one or more corresponding pins in the associated die holder to fix angular orientation of the groove relative to the die holder.

13. A manufacture comprising:

a die for mounting in an associated die holder for the production of heads on elongate bodies, the die having a substantially cylindrical shape and including:

a body with a top surface provided with a through-going groove for receiving and holding an elongate body longitudinally in said groove, a recess at one end of the groove configured to form a head on the elongate body, a side surface shaped for press fit by contact with an inner surface of a bore or hole in the associated die holder, a stop surface for engaging with a stop part in the hole or bore of the associated die holder, so as to fix a height of the die in relation to the associated die holder, and a recess or protrusion configured to engage a corresponding protrusion or recess of the associated die holder to fix angular orientation of the groove relative to the die holder, wherein the stop surface or bottom surface of said die has a groove on at least a portion of said stop surface or bottom surface, so as to allow an associated tool to engage with the groove in order to push the die upwards for removal of the die from an associated die holder, and wherein the groove is an inclined groove with an inclination angle between 2° to 20° relative to the stop surface or bottom surface of the die.

14. The manufacture according to claim 13, wherein the inclined groove has a width (W) and the die has an outer diameter (D), and where a ratio (W/D) between said width and said outer diameter is between 0.1 and 0.5.

15. The manufacture according to claim 13, wherein said inclined groove has at least a plane surface part.

16. The manufacture according to claim 15, wherein said inclined groove is a plane surface being parallel with an axis perpendicular to a central axis of the die.

17. The manufacture according to claim 15, wherein said plane surface has an inclination angle of 2° to 20° relative to the stop surface or bottom surface of the die.

18. The manufacture according to claim 13, wherein said inclined groove has at least a curved surface part.

19. A manufacture comprising:

a die for mounting in an associated die holder for the production of heads on elongate bodies, the die having a substantially cylindrical shape and including:

a body with a top surface provided with a through-going groove for receiving and holding an elongate body longitudinally in said groove, a recess at one end of the groove configured to form a head on the elongate body, a side surface shaped for press fit by contact with an inner surface of a bore or hole in the associated die holder, a stop surface for engaging with a stop part in the hole or bore of the associated die holder, so as to fix a height of the die in relation to the associated die holder, and a recess or protrusion configured to engage a corresponding protrusion or recess of the associated die holder to fix angular orientation of the groove relative to the die holder, wherein an outer diameter (D) and an overall height (H) of said die has a ratio between 0.5 and 2.0.

20. A system for producing elongated bodies comprising:

a die for mounting in an associated die holder for the production of heads on elongate bodies, the die having a substantially cylindrical shape and including:

a body with a top surface provided with a through-going groove for receiving and holding an elongate body longitudinally in said groove, a recess at one end of the groove configured to form a head on the elongate body, a side surface shaped for press fit by contact with an inner surface of a bore or hole in the associated die holder, a stop surface for engaging with a stop part in the hole or bore of the associated die holder, so as to fix a height of the die in relation to the associated die holder, and a recess or protrusion configured to engage a corresponding protrusion or recess of the associated die holder to fix angular orientation of the groove relative to the die holder; and a machine including a die holder configured to receive the die, the die holder including:

a body having at least a top surface part, a hole or bore in the top surface part, wherein the hole or bore has an inner surface shaped for receiving the die and for press fit by contact with the side surface of the die, a stop part located in the hole or bore for engaging with the stop surface of the die when being pressed into the hole or bore, so as to fix a height of the top surface of the die in relation to the top surface part of the die holder, and a protrusion or recess serving to engage with a corresponding recess or protrusion of the die, in order to fix angular orientation of the groove of the die relative to the die holder.

21. The system according to claim 20, wherein the top surface part of the die holder is ring-shaped, having a central axis of rotation, the ring-shaped die holder being mounted so as to rotate about said axis.

22. The system according to claim 20, wherein the top surface of the ring-shaped circular die holder has a plurality of holes or bores, arranged for mounting of a respective die.

23. The system according to claim 20, wherein the die holder body has an opening, connected to a bottom part of the hole or bore shaped for receiving and holding the die, so as to allow an elongate tool to engage with a lower part of the die to push the die upwards for removal of the die from the die holder.

24. The system according to claim 23, wherein the die holder is ring-shaped, and wherein said opening is located on an inner side of the ring, so as to allow removal of the die, when the die holder is mounted for normal operation.

* * * * *